US010030209B2

(12) United States Patent
Thomas et al.

(10) Patent No.: US 10,030,209 B2
(45) Date of Patent: Jul. 24, 2018

(54) LUBRICANT FOR POWDER METALLURGY AND METAL POWDER COMPOSITIONS CONTAINING SAID LUBRICANT

(71) Applicant: NATIONAL RESEARCH COUNCIL OF CANADA, Ottawa (CA)

(72) Inventors: Yannig Thomas, Montreal (CA); Vincent Paris, Sorel-Tracy (CA); Sylvain St-Laurent, Repentigny (CA)

(73) Assignee: NATIONAL RESEARCH COUNCIL OF CANADA, Ottawa (CA)

( * ) Notice: Subject to any disclaimer, the term of this patent is extended or adjusted under 35 U.S.C. 154(b) by 832 days.

(21) Appl. No.: 14/484,833

(22) Filed: Sep. 12, 2014

(65) Prior Publication Data

US 2015/0068361 A1 Mar. 12, 2015

Related U.S. Application Data

(60) Provisional application No. 61/877,086, filed on Sep. 12, 2013.

(51) Int. Cl.
*B22F 1/02* (2006.01)
*C10M 171/06* (2006.01)
(Continued)

(52) U.S. Cl.
CPC ..... *C10M 171/06* (2013.01); *B22F 1/0059* (2013.01); *B22F 2001/0066* (2013.01);
(Continued)

(58) Field of Classification Search
None
See application file for complete search history.

(56) References Cited

U.S. PATENT DOCUMENTS 3,539,472 A 11/1970 Findeisen et al.
5,782,954 A 7/1998 Luk
(Continued)

FOREIGN PATENT DOCUMENTS

CA 2636906 A1 7/2007
EP 1968761 B1 3/2013
(Continued)

OTHER PUBLICATIONS

Thomas, Yannig et al., "Behavior of Conventional and New PM Lubricants as a Function of Processing Parameters", Europ PM2011 Congress Proceedings—vol. 3, p. 9, Powder Pressing, 2011, Barcelona.

(Continued)

*Primary Examiner* — Jessee R Roe
*Assistant Examiner* — Ngoclan T Mai
(74) *Attorney, Agent, or Firm* — Robic, LLP

(57) ABSTRACT

A particulate composite lubricant for powder metallurgy comprises: first discrete particles comprising at least about 90 wt % of a fatty primary monoamide wax, being substantially free of fatty bisamide wax, and being at least partially coated with metal oxide nanoparticles and second metal-stearate free discrete particles comprising a fatty bisamide wax. A particulate composite lubricant for powder metallurgy can comprise: a Montan acid ester wax and at least one fatty amide wax comprising at least one of a fatty monoamide wax and a fatty bisamide wax.

20 Claims, 19 Drawing Sheets

(51) Int. Cl.
*B22F 1/00* (2006.01)
*B22F 3/02* (2006.01)

(52) U.S. Cl.
CPC ..... *B22F 2003/023* (2013.01); *C10M 2201/0623* (2013.01); *C10M 2201/1053* (2013.01); *C10M 2205/0206* (2013.01); *C10M 2205/163* (2013.01); *C10M 2207/2805* (2013.01); *C10M 2209/1023* (2013.01); *C10M 2215/0806* (2013.01); *C10M 2217/0443* (2013.01); *C10N 2220/082* (2013.01); *C10N 2240/40* (2013.01); *C10N 2250/18* (2013.01)

(56) References Cited

U.S. PATENT DOCUMENTS

| | | | |
|---|---|---|---|
| 6,224,823 | B1 | 5/2001 | Lindenau et al. |
| 6,316,393 | B1 | 11/2001 | Thomas et al. |
| 7,247,187 | B2 | 7/2007 | Ramstedt et al. |
| 7,329,302 | B2 | 2/2008 | McCall |
| 7,524,352 | B2 | 4/2009 | Lindenau et al. |
| 7,682,558 | B2 | 3/2010 | Knutsson et al. |
| 7,857,903 | B2 | 12/2010 | Lindenau et al. |
| 7,993,429 | B2 | 8/2011 | Ahlin et al. |
| 8,075,710 | B2 | 12/2011 | Skarman et al. |
| 8,092,615 | B2 | 1/2012 | Kjellen et al. |
| 2001/0035069 | A1 | 11/2001 | Arvidsson |
| 2004/0254280 | A1 | 12/2004 | Richter et al. |
| 2006/0099104 | A1* | 5/2006 | McCall ..... B22F 1/0059 419/37 |
| 2011/0265602 | A1 | 11/2011 | Ahlin |
| 2012/0031233 | A1 | 2/2012 | Lindenau et al. |
| 2013/0015394 | A1 | 1/2013 | Skarman et al. |
| 2013/0224060 | A1 | 8/2013 | Hanejko et al. |

FOREIGN PATENT DOCUMENTS

| | | | |
|---|---|---|---|
| JP | 4423000 | B2 | 3/2010 |
| WO | 0117716 | A1 | 3/2001 |
| WO | 0119508 | A1 | 3/2001 |
| WO | 0140416 | A1 | 6/2001 |
| WO | 02083346 | A1 | 10/2002 |
| WO | 2006031193 | A1 | 3/2006 |
| WO | 2006047858 | A1 | 5/2006 |
| WO | 2007078232 | A1 | 7/2007 |
| WO | 2010062250 | A1 | 6/2010 |
| WO | 2011051293 | * | 5/2011 |

OTHER PUBLICATIONS

Paris, Vincent et al., "Novel High Performance Lubricants for Conventional and High-Density Compaction", Advances in Powder Metallurgy & Particulate Materials, Part 3—General Compaction & Forming Processes, 14 pages, 2012, Nashville.

Paris, Vincent et al., "High Performance Lubricants for Conventional Medium Density Compaction" 8 pages, 2012, Yokohama.

* cited by examiner

LUBRICANT FOR POWDER METALLURGY AND METAL POWDER COMPOSITIONS CONTAINING SAID LUBRICANT

CROSS-REFERENCE TO RELATED APPLICATIONS

This application claims priority under 35 USC § 119(e) of U.S. provisional patent application 61/877,086 filed on Sep. 12, 2013, the specification of which is hereby incorporated by reference.

TECHNICAL FIELD OF THE INVENTION

The technical field relates to a metal powder composition including a lubricant. More particularly, it relates to a particulate composite lubricant for powder metallurgy and to a process for producing a powder composition for powder metallurgy including the particulate composite lubricant.

BACKGROUND

In the Powder Metallurgy industry (PM industry), metal powders, such as iron-based powders, are used for production of components. More particularly, metal powder compositions are compacted in a die under high pressure into green compacts, the green compacts are then ejected from the die and sintered into sintered compacts. This near net shape technology enables the production of parts at a lower cost than other conventional methods such as machining.

The metal powder composition comprises a mixture of metal powders, lubricant, and, optionally, other additives. The powder metallurgy lubricants are generally different types of waxes, which are either ground or atomized into fine particles, and blended with metal powders, such as iron and steel powders. The lubricant reduces the inter-particular friction and the friction with the die wall during compaction and therefore improves densification, but also reduces friction with the die wall during the ejection of the part from the die. Furthermore, the lubricant is selected to promote the metal powder composition to flow adequately within the die cavity and also be malleable enough not to hinder the compaction process. There is a strong relationship between the mechanical properties and the final density of the parts. Consequently, lubricants which allow for higher densities to be attained have additional value. Commonly used lubricants for PM applications comprise metal stearates and amide waxes such as ethylene bisstearamide wax. Albeit being excellent lubricants, metal stearates can stain the parts during sintering and cause heavy metal contamination through the sintering furnace exhaust fumes.

BRIEF SUMMARY OF THE INVENTION

It is therefore an aim of the present invention to address the above mentioned issues.

According to a general aspect, there is provided a particulate composite lubricant for powder metallurgy comprising: first discrete particles comprising at least about 90 wt % of a fatty primary monoamide wax, being substantially free of fatty bisamide wax, and being at least partially coated with metal oxide nanoparticles and second metal-stearate free discrete particles comprising a fatty bisamide wax.

In an embodiment, the particulate composite lubricant comprises between about 10 wt % and about 60 wt % of the first discrete particles.

In an embodiment, the particulate composite lubricant comprises between about 40 wt % and about 90 wt % of the second discrete particles.

In an embodiment, the first discrete particles consist essentially of the fatty primary monoamide wax at least partially coated with the metal oxide nanoparticles.

In an embodiment, the first discrete particles consist of the fatty primary monoamide wax at least partially coated with the metal oxide nanoparticles.

In an embodiment, the second discrete particles further comprise at least about 50 wt % of the fatty bisamide wax and less than about 10 wt % of a fatty primary monoamide wax.

In an embodiment, the second discrete particles further comprise at least about 90 wt % of the fatty bisamide wax. For instance, the second discrete particles consist essentially of the fatty bisamide wax.

In an embodiment, the fatty bisamide wax of the second discrete particles comprises at least two fatty bisamide waxes.

In an embodiment, the fatty primary monoamide wax is a monoamide of a fatty acid of 12 to 24 carbons. The monoamide can be selected from the group consisting of: lauramide, palmitamide, stearamide, arachidamide, behenamide, oleamide, erucamide, and combinations thereof.

In an embodiment, the metal oxide nanoparticles comprise at least one of iron oxides, $TiO_2$, $Al_2O_3$, $SnO_2$, $SiO_2$, $CeO_2$, and indium titanium oxide nanoparticles, and combinations thereof. In another embodiment, the metal oxide nanoparticles comprise fumed silica nanoparticles.

In an embodiment, the first discrete particles comprises less than about 5 wt % of metal oxide nanoparticles.

In an embodiment, the first discrete particles are smaller than about 250 μm.

In an embodiment, the at least partially coated first discrete particles have an average particle size between about 15 μm and about 100 μm.

In an embodiment, a D99 of the at least partially coated first discrete particles is between about 80 μm and about 220 μm.

In an embodiment, the fatty bisamide wax is a fatty acid bisamide selected from the group consisting of: methylene bisoleamide, methylene bisstearamide, ethylene bisoleamide, hexylene bisstearamide, and ethylene bisstearamide (EBS), and mixtures thereof.

In an embodiment, the second discrete particles have an average particle size smaller than about 50 μm.

In an embodiment, a D99 of the second discrete particles is smaller than about 200 μm.

In an embodiment, the second discrete particles are substantially metal free.

In a particular embodiment, the first discrete particles comprise erucamide particles and the metal oxide nanoparticles comprise fumed silica nanoparticles and the second discrete particles comprise ethylene bisstearamide particles. The particular composite lubricant can comprise between about 10 wt % and about 60 wt % of the erucamide particles and between about 40 wt % and about 90 wt % of the ethylene bisstearamide particles. The erucamide particles can have an average particle size of about 60 μm and a diameter smaller than about 175 μm.

According to another general aspect, there is provided a metallurgical powder composition, comprising a metal-based powder admixed with the particulate composite lubricant as described above in a concentration ranging between about 0.1 wt % and about 5 wt %. In an embodiment, the metal-based powder is an iron-based powder.

According to another general aspect, there is provided a process for producing a powder composition for powder metallurgy. The process comprises: adding the particulate composite lubricant as described above in a concentration ranging between about 0.1 wt % and about 5 wt %, based on a total weight of the powder composition, to a metal-based powder. In an embodiment, the metal-based powder is an iron-based powder.

According to still another general aspect, there is provided a particulate composite lubricant for powder metallurgy. The particulate composite lubricant comprises: first discrete particles comprising a fatty primary monoamide wax, being substantially free of fatty bisamide wax, and being at least partially coated with metal oxide nanoparticles, the at least partially coated first discrete particles having average particle size between about 15 μm and about 100 μm, and second metal-stearate free discrete particles comprising a fatty bisamide wax and having average particle size smaller than about 50 μm.

In an embodiment, the at least partially coated first discrete particles have an average particle size between about 25 μm and about 75 μm.

In an embodiment, a D99 of the at least partially coated first discrete particles is between about 80 μm and about 220 μm.

In an embodiment, a D99 of the at least partially coated first discrete particles is between about 115 μm and about 180 μm.

In an embodiment, the second discrete particles have an average particle size smaller than about 15 μm.

In an embodiment, a D99 of the second discrete particles is smaller than about 200 μm.

In an embodiment, a D99 of the second discrete particles is smaller than about 150 μm.

In an embodiment, the first discrete particles comprise at least about 90 wt % of the fatty primary monoamide wax.

In an embodiment, the particulate composite lubricant comprises between about 10 wt % and about 60 wt % of the first discrete particles.

In an embodiment, the particulate composite lubricant comprises between about 40 wt % and about 90 wt % of the second discrete particles.

In an embodiment, the first discrete particles consist essentially of the fatty primary monoamide wax at least partially coated with the metal oxide nanoparticles.

In an embodiment, the first discrete particles consist of the fatty primary monoamide wax at least partially coated with the metal oxide nanoparticles.

In an embodiment, the second discrete particles further comprise at least about 50 wt % of the fatty bisamide wax and less than about 10 wt % of a fatty primary monoamide wax.

In an embodiment, the second discrete particles further comprise at least about 90 wt % of the fatty bisamide wax.

In an embodiment, the second discrete particles consist essentially of the fatty bisamide wax.

In an embodiment, the second discrete particles are substantially metal free.

In an embodiment, the fatty primary monoamide wax is a monoamide of a fatty acid of 12 to 24 carbons. The monoamide can be selected from the group consisting of: lauramide, palmitamide, stearamide, arachidamide, behenamide, oleamide, erucamide, and combinations thereof.

In an embodiment, the metal oxide nanoparticles comprise at least one of iron oxides, $TiO_2$, $Al_2O_3$, $SnO_2$, $SiO_2$, $CeO_2$, and indium titanium oxide nanoparticles, and combinations thereof.

In an embodiment, the metal oxide nanoparticles comprise fumed silica nanoparticles.

In an embodiment, the first discrete particles comprises less than about 5 wt % of metal oxide nanoparticles.

In an embodiment, the first discrete particles are smaller than about 250 μm.

In an embodiment, the fatty bisamide wax is a fatty acid bisamide selected from the group consisting of: methylene bisoleamide, methylene bisstearamide, ethylene bisoleamide, hexylene bisstearamide, and ethylene bisstearamide (EBS), and mixtures thereof.

In an embodiment, the second discrete particles have an average particle size smaller than about 50 μm.

In a particular embodiment, the first discrete particles comprise erucamide particles and the metal oxide nanoparticles comprise fumed silica nanoparticles and the second discrete particles comprise ethylene bisstearamide particles. The particular composite lubricant can comprise between about 10 wt % and about 60 wt % of the erucamide particles and between about 40 wt % and about 90 wt % of the ethylene bisstearamide particles. The erucamide particles can have an average particle size of about 60 μm and a diameter smaller than about 175 μm.

According to a further general aspect, there is provided a metallurgical powder composition, comprising a metal-based powder admixed with the particulate composite lubricant as described above in a concentration ranging between about 0.1 wt % and about 5 wt %. In an embodiment, the metal-based powder is an iron-based powder.

According to a further general aspect, there is provided a process for producing a powder composition for powder metallurgy. The process comprises: adding the particulate composite lubricant as described above in a concentration ranging between about 0.1 wt % and about 5 wt %, based on a total weight of the powder composition, to a metal-based powder. In an embodiment, the metal-based powder is an iron-based powder.

According to a further general aspect, there is provided a particulate composite lubricant for powder metallurgy comprising: a Montan acid ester wax and at least one fatty amide wax comprising at least one of a fatty monoamide wax and a fatty bisamide wax.

In an embodiment, the particulate composite lubricant comprises first discrete particles comprising the Montan acid ester wax. The first discrete particles can further comprise the fatty monoamide wax and the fatty monoamide wax can comprise a fatty primary monoamide wax. In an embodiment, the particulate composite lubricant can further comprise second discrete particles comprising an organic, metal-free pulverulent lubricant selected from the group consisting of fatty bisamide waxes, fatty monoamide waxes, glycerides, Montan acid ester waxes, paraffin wax, polyolefines, polyamides, polyesters, and mixtures thereof. In an embodiment, the particulate composite lubricant can further comprise second discrete particles including the fatty bisamide wax. The second discrete particles can further comprise the Montan acid ester wax.

In an embodiment, the first discrete particles are at least partially coated with metal oxide nanoparticles.

In an embodiment, the first discrete particles further comprise the fatty bisamide wax. The particulate composite lubricant can further comprise second discrete particles comprising an organic, metal-free pulverulent lubricant selected from the group consisting of fatty bisamide waxes, fatty monoamide waxes, glycerides, Montan acid ester waxes, paraffin wax, polyolefines, polyamides, polyesters, and mixtures thereof. The particulate composite lubricant can further comprise second discrete particles including the fatty monoamide wax and the fatty monoamide wax comprises a fatty primary monoamide wax. In an embodiment, the second discrete particles are at least partially coated with metal oxide nanoparticles.

In an embodiment, the particulate composite lubricant comprises first discrete particles and second discrete particles, the first discrete particles comprise the Montan acid ester wax and the fatty monoamide wax including erucamide and the second discrete particles comprise ethylene bisstearamide. The first discrete particles can be at least partially coated with metal oxide nanoparticles. The second discrete particles can further comprise Montan acid ester wax.

In an embodiment, the particulate composite lubricant comprises first discrete particles comprising the Montan acid ester wax and the fatty bisamide wax including ethylene bisstearamide. The particulate composite lubricant can further comprise second discrete particles comprising erucamide. The second discrete particles can be at least partially coated with metal oxide nanoparticles. The second discrete particles can further comprise Montan acid ester wax. In an alternative embodiment, the particulate composite lubricant can be free of second discrete particles.

In an embodiment, the particulate composite lubricant comprises first discrete particles comprising the Montan acid ester wax and the fatty monoamide wax including erucamide and is free of second discrete particles. The first discrete particles can be at least partially coated with metal oxide nanoparticles.

In an embodiment, the particulate composite lubricant comprises first discrete particles comprising the Montan acid ester wax and second discrete particles comprising the at least one fatty amide wax. The particulate composite lubricant can further comprise third discrete particles comprising an organic, metal-free pulverulent lubricant selected from the group consisting of fatty bisamide waxes, fatty monoamide waxes, glycerides, paraffin wax, polyolefines, polyamides, polyesters, and mixtures thereof.

In an embodiment, the particulate composite lubricant is stearate free.

In an embodiment, the particulate composite lubricant comprises between about 10 wt % and about 99.5 wt % of the at least one fatty amide wax.

In an embodiment, the particulate composite lubricant comprises between about 0.5 wt % and about 90 wt % of the Montan acid ester wax. In an embodiment, a remaining portion of the particulate composite lubricant comprises the at least one fatty amide wax. The remaining portion can comprise a metal oxide nanoparticle coating.

In an embodiment, the at least one fatty amide wax is selected from the group consisting of: primary monoamide waxes, secondary monoamide waxes, bisamide waxes, and mixtures thereof.

In an embodiment, the fatty amide wax is selected from the group consisting of: lauramide, palmitamide, stearamide, oleamide, arachidamide, behenamide, erucamide, stearyl stearamide, stearyl oleamide, stearyl erucamide, oleyl palmitamide, oleyl stearamide, erucyl stearamide, erucyl erucamide, ethylene bisstearamide, ethylene bisoleamide, hexamethylene bisstearamide, and mixtures thereof.

In an embodiment, the particulate composite lubricant is obtained by melting the at least one fatty amide wax and the Montan acid ester wax, then cooling and grinding the at least one fatty amide wax and the Montan acid ester wax into discrete particles.

In an embodiment, the particulate composite lubricant is obtained by melting the at least one fatty amide wax and the Montan acid ester wax, then atomizing the at least one fatty amide wax and the Montan acid ester wax into discrete particles.

In an embodiment, the particulate composite lubricant comprises first discrete particles comprising the Montan acid ester wax and second discrete particles comprising the fatty amide wax. The second discrete particles of the fatty amide wax can be at least partially coated with metal oxide nanoparticles. The metal oxide nanoparticles can comprise fumed silica nanoparticles. The particulate composite lubricant can further comprise third discrete particles comprising an organic, metal-free pulverulent lubricant selected from the group consisting of fatty bisamide waxes, fatty monoamide waxes, glycerides, Montan acid ester waxes, paraffin wax, polyolefines, polyamides, polyesters, and mixtures thereof.

According to still another general aspect, there is provided a metallurgical powder composition, comprising a metal-based powder admixed with the particulate composite lubricant as described above. The metal-based powder can be an iron-based powder.

According to still another general aspect, there is provided a process for producing a powder composition for powder metallurgy, comprising: adding a particulate composite lubricant as described above in a concentration ranging between about 0.1 wt % to about 5 wt %, based on a total weight of the powder composition, to a metal-based powder. The metal-based powder can be an iron-based powder.

In this specification, a substance is a wax if it is kneadable at about 20° C., is solid to brittle, has a coarse to microcrystalline structure, is translucent to opaque, not glassy, melts above 40° C. without decomposing, is slightly liquid (less viscous) just above the melting point, has a strongly temperature-dependent consistency and solubility, and is polishable under slight pressure.

In this specification, the term "composite" is intended to mean a combination of at least two components. The components can be melted or agglomerated together or provided as distinct discrete particles.

The present document refers to a number of documents, the contents of which are hereby incorporated by reference in their entirety.

DETAILED DESCRIPTION

Figure 1:
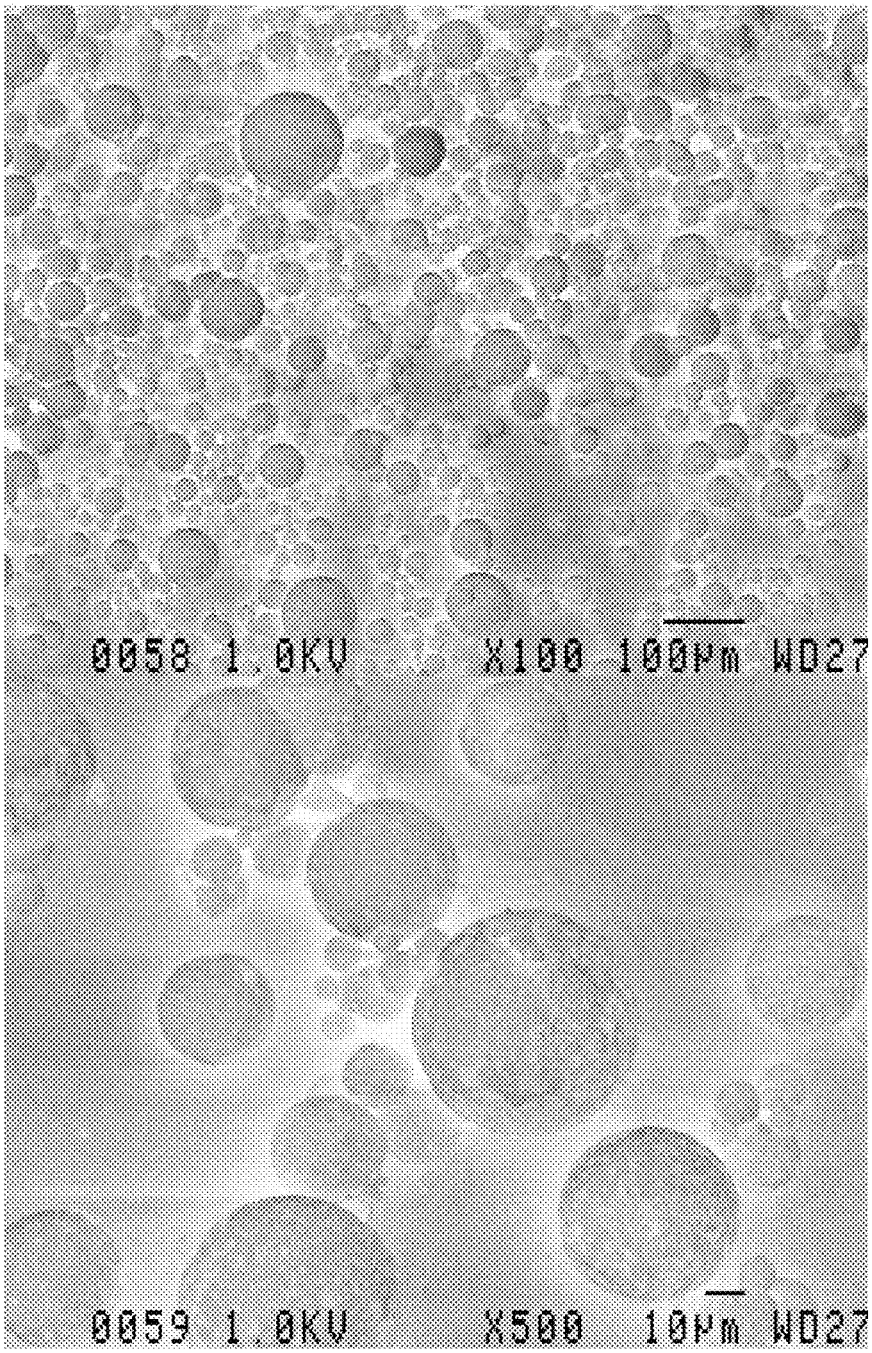
FIG. 1 is a SEM micrograph of erucamide wax particles having a D99 of 175 μm and an average particle size of 63 μm, coated with 0.5 wt % of fumed silica.

In reference to the accompanying drawings, a particulate composite lubricant for a metal powder composition, such as and without being limitative, an iron-based powder composition will be described. The composite lubricant can act as a compaction aid and/or a pressing aid for the metal powder composition. The composite lubricant is based on fatty acid waxes.

In an embodiment, the particulate composite lubricant comprises a combination of first discrete particles including a fatty primary monoamide wax at least partially coated with metal oxide nanoparticles and second discrete particles including a fatty bisamide wax. The second discrete particles are free of metal-stearate and, in an embodiment, free of metal particles.

In an embodiment, the first discrete particles comprise at least about 90 wt % of the fatty primary monoamide wax. It is appreciated that the first discrete particles can comprise more than one fatty primary monoamide wax, i.e. a combination of fatty primary monoamide waxes. They are substantially free of fatty bisamide wax.

In an embodiment, the second discrete particles can include other component than the fatty bisamide wax. For instance, they can comprise a relatively small amount of a fatty primary monoamide wax. In an embodiment, the second discrete particles comprise at least about 50 wt % of the fatty bisamide wax and less than about 10 wt % of a fatty primary monoamide wax. In another embodiment, the second discrete particles can comprise at least about 90 wt % of the fatty bisamide wax and, for instance, less than about 1 wt % of fatty primary monoamide wax. It is appreciated that the second discrete particles can comprise more than one fatty bisamide wax, i.e. a combination of fatty bisamide waxes.

In an embodiment, the particulate composite lubricant comprises between about 10 wt % and about 60 wt % of the first discrete particles including the fatty primary monoamide wax at least partially coated with the metal oxide nanoparticles and, in another embodiment, between about 25 wt % and about 45 wt % of the first discrete particles. In an embodiment, the particulate composite lubricant comprises between about 40 wt % and about 90 wt % of the second discrete particles including the fatty bisamide wax and, in another embodiment, between about 55 wt % and about 75 wt % of the second discrete particles.

In an embodiment, the fatty primary monoamide wax is a monoamide of a fatty acid, saturated or unsaturated, of 12 to 24 carbons, which can be selected from the group comprising: lauramide, palmitamide, stearamide, oleamide, arachidamide, behenamide, erucamide, and combinations thereof.

Fatty primary monoamide waxes are hydrophilic molecules, due to the polarity of their amide function. Thus, substantially pure fatty primary monoamide wax particles tend to agglomerate over time, especially if they are exposed to higher humidity environments. When the fatty primary monoamide wax particles are admixed to metal powder, the exposure of the powder mix to relatively high humidity levels will cause the flow rate of the powder mix to deteriorate.

In order to counteract the hydrophilic nature of the fatty primary monoamide wax, a coating of metal oxide nanoparticles, such as and without being limitative fumed silica, can be applied on the fatty primary monoamide wax-based particles. This coating will insure a proper powder mix flow rate. In order for the metal oxides nanoparticles to protect the fatty primary monoamide wax against humidity, it must be coated superficially, i.e. adhered on the surface. The admixing of metal oxides nanoparticles to the metal powder blends, as often done to increase their flow properties, will not offer any protection against exposure to humid environments. Such blends tend to exhibit no flow in a Hall funnel.

The first discrete particles are at least partially coated with nanoparticles of at least one metal oxide. The metal oxide nanoparticles cover, at least partially, an outer surface of the fatty primary monoamide wax-based particles. The metal oxide nanoparticles can be iron oxides, $TiO_2$, $Al_2O_3$, $SnO_2$, $SiO_2$, $CeO_2$, and indium titanium oxide nanoparticles or combinations thereof. In an embodiment, the metal oxide nanoparticles comprise fumed silica nanoparticles. The nanoparticles are smaller than about 200 nm. In an embodiment, they are smaller than about 100 nm. In an embodiment, the primary particle size is between about 5 and 50 nm. In an embodiment, the metal oxide nanoparticle coating represents less than about 5 wt % of the weight of the primary discrete particles and, in another embodiment, less than about 2 wt %.

The at least partially coated discrete particles of the fatty primary monoamide wax are characterized by a diameter smaller than about 250 μm and having an average particle size larger than about 10 μm. In an embodiment, they are characterized by an average particle size between about 15 μm and about 100 μm and, in another embodiment, between about 25 μm and about 75 μm. In an embodiment, they are characterized by a D99 between about 80 μm and about 220 μm, i.e. 99% of the particles are smaller than the D99, and, in another embodiment, between about 115 μm and about 180 μm.

In an embodiment, the fatty bisamide wax is a fatty acid bisamide which can be selected from the group consisting of methylene bisoleamide, methylene bisstearamide, ethylene bisoleamide, hexylene bisstearamide, and ethylene bisstearamide (EBS), and mixtures thereof.

In an embodiment, the second discrete particles are characterized by an average particle size smaller than about 50 μm and, in another embodiment, smaller than about 15 μm. In an embodiment, they are characterized by a D99 smaller than about 200 μm and, in another embodiment, smaller than about 150 μm.

In an implementation, the composite lubricant comprises discrete particles of erucamide, as fatty primary monoamide wax, at least partially coated with fumed silica nanoparticles, as metal oxide, mixed with discrete particles of ethylene bisstearamide (EBS), as fatty bisamide wax. Erucamide is a fatty primary monoamide wax and, more particularly, a monounsaturated fatty acid based wax (C22:1) and EBS is a fatty bisamide wax. In an embodiment, the composite lubricant comprises between about 10 wt % and about 60 wt % of the erucamide particles at least partially coated with fumed silica nanoparticles. In an embodiment, the composite lubricant comprises between about 40 wt % and about 90 wt % of EBS.

In an implementation, the particles of erucamide are substantially spherical and have a larger diameter than the particles typically used as lubricant in powder metallurgy. More particularly, they are characterized by an average particle size of about 60 micrometer (μm) and their diameter is smaller than about 175 μm. For instance, the particles of the lubricant Acrawax® C, which is a typically used lubricant in powder metallurgy, are characterized by an average particle size of about 5 to 7 micrometer (μm) and their diameter is smaller than about 25 μm. Acrawax® C is an amide wax and, more particularly, a N,N'-ethylene bisstearamide.

Figure 2:
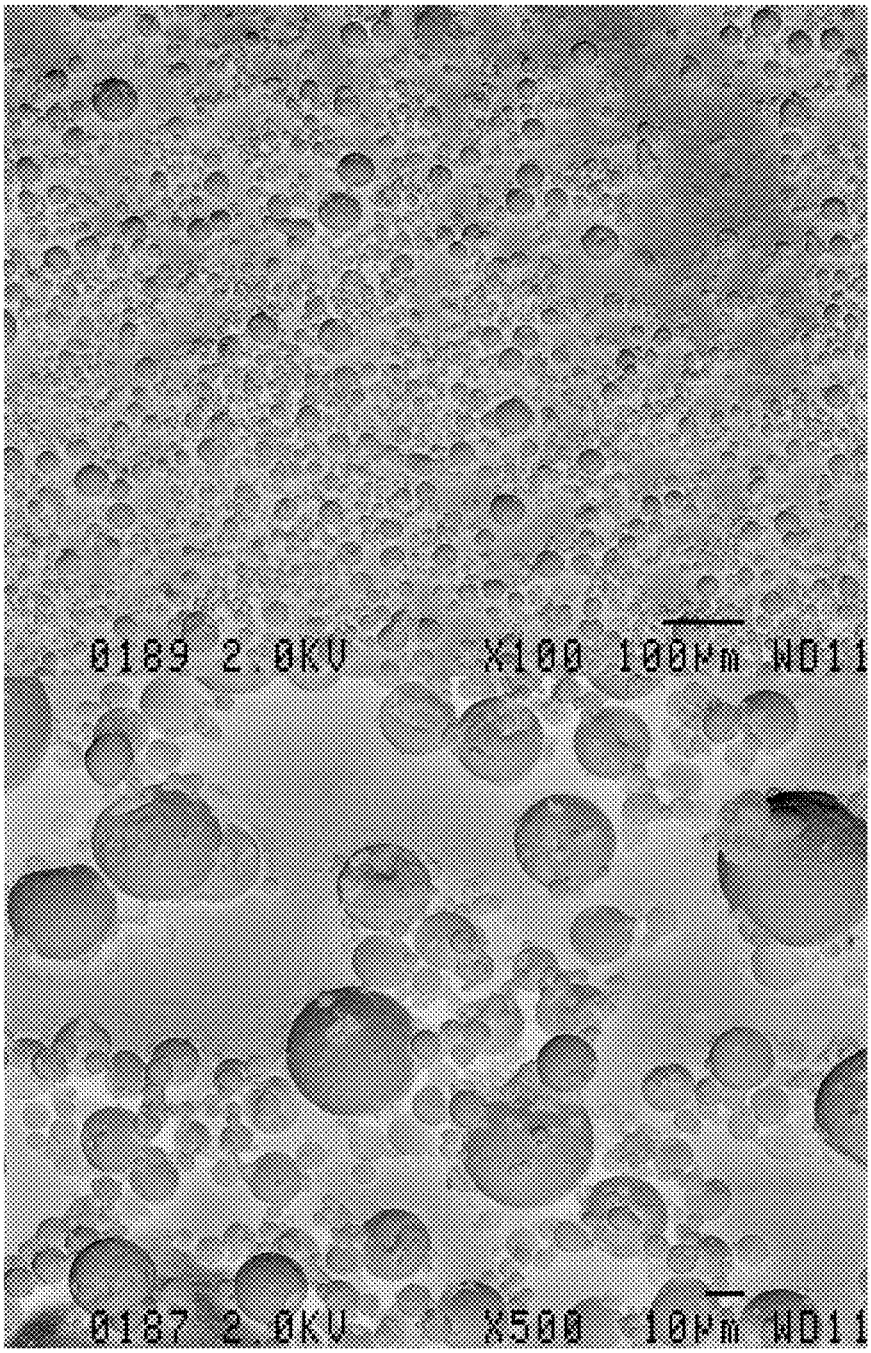
FIG. 2 is a SEM micrograph of ethylene bisstearamide (EBS) wax particles having a D99 of 80 μm and an average particle size of 22 μm.
Figure 3:
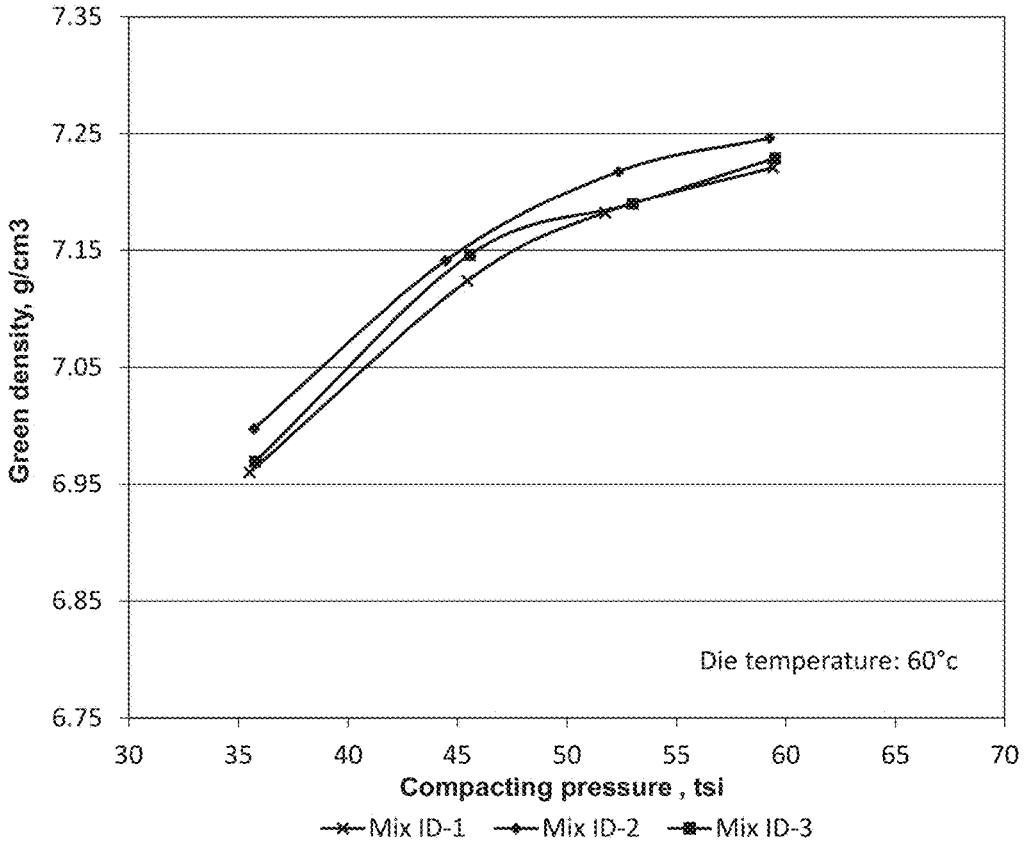
FIG. 3 is a graph showing the green density as a function of the compacting pressure for three lubricants of example A.
Figure 4:
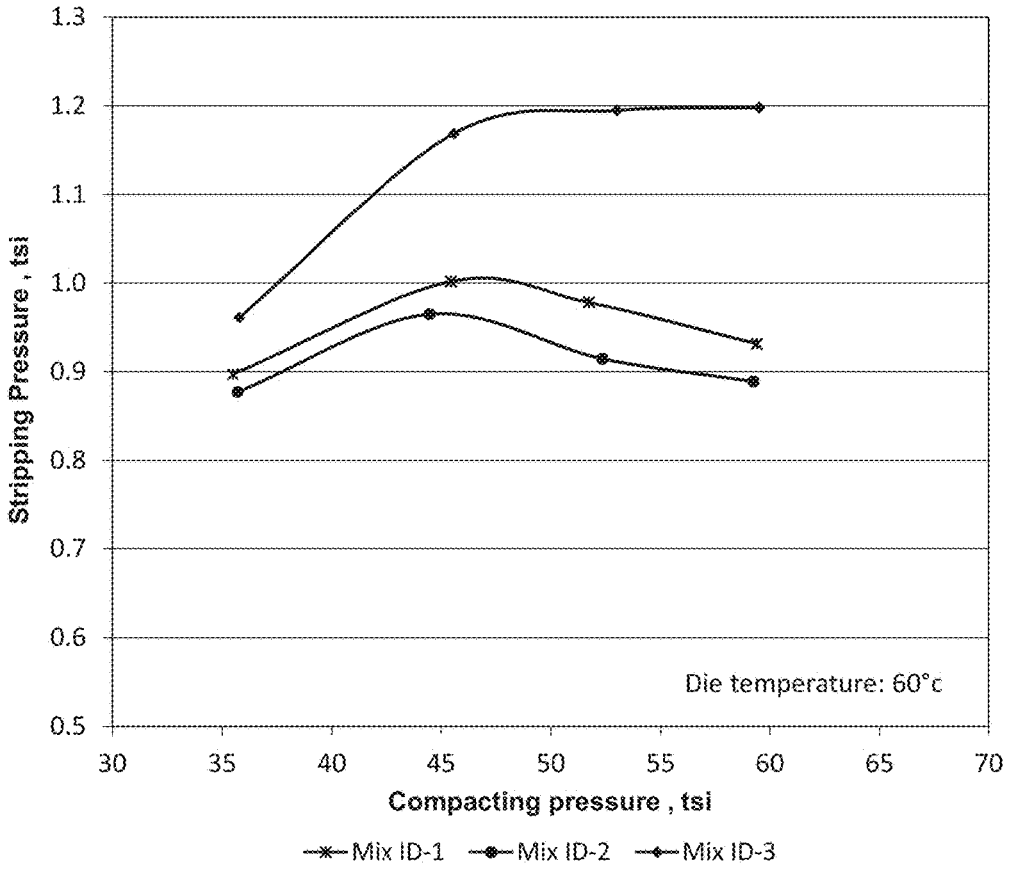
FIG. 4 is a graph showing the stripping pressure as a function of the compacting pressure for the three lubricants of example A.
Figure 5:
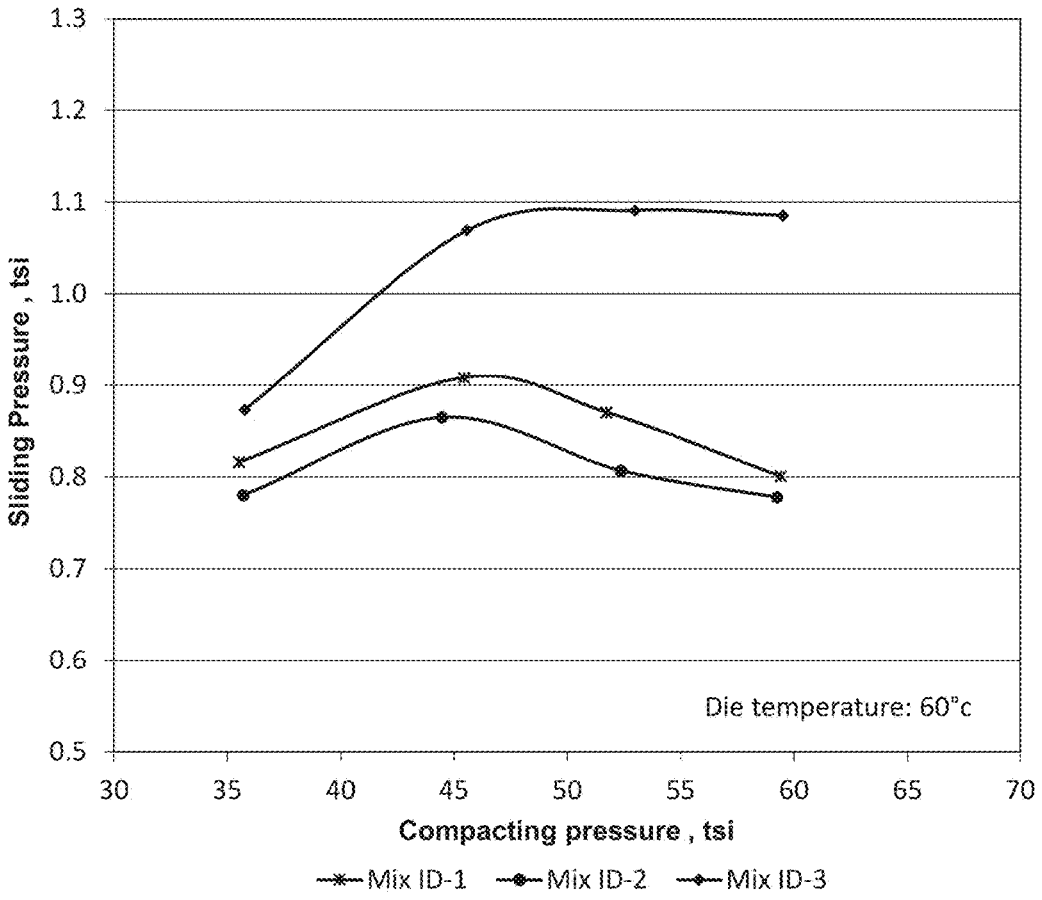
FIG. 5 is a graph showing the sliding pressure as a function of the compacting pressure for the three lubricants of example A.
Figure 6:
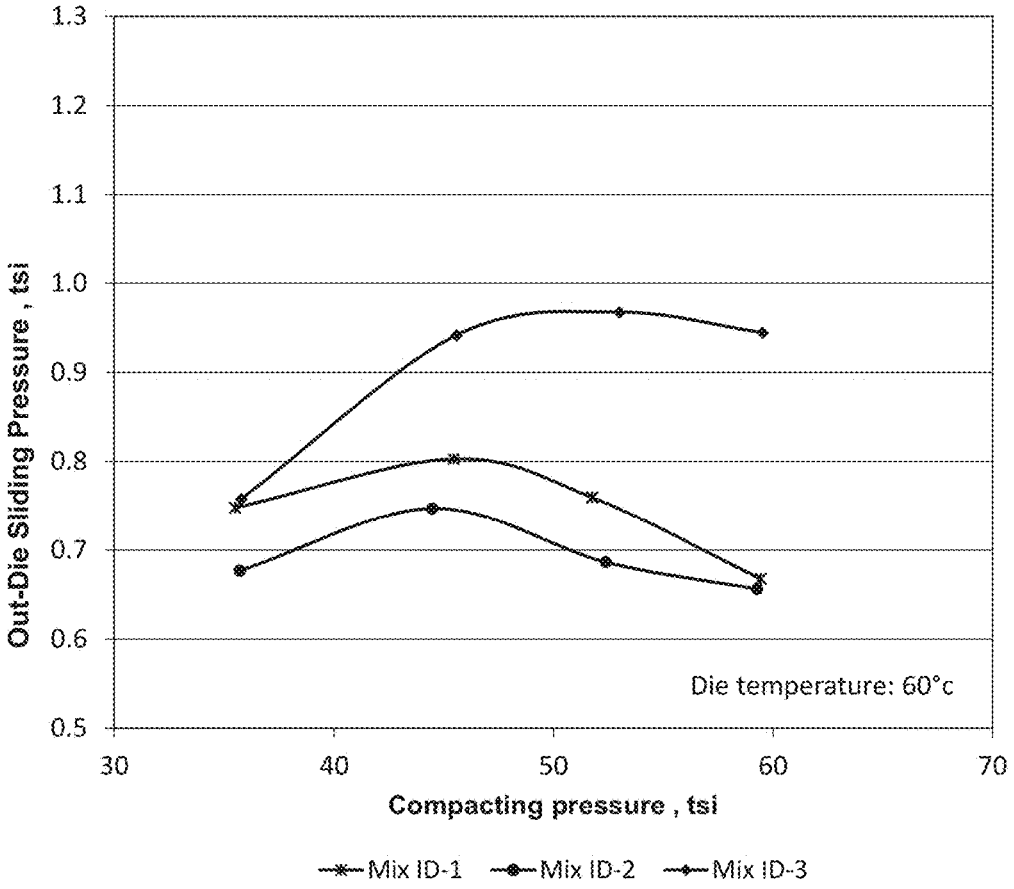
FIG. 6 is a graph showing the out-die sliding pressure as a function of the compacting pressure the three lubricants of example A.

FIG. 1 is a SEM micrograph of erucamide wax particles having a D99 of 175 μm coated with 0.5% wt % of fumed silica which can be mixed with EBS wax particles to obtain the composite lubricant. FIG. 2 is a SEM micrograph of EBS wax particles having a D99 of 80 μm, which can be combined with the particles shown in FIG. 1.

In an embodiment, to manufacture the discrete particles of fatty primary monoamide wax at least partially coated with metal oxide nanoparticles, the lubricant particles can be prepared by melting the fatty primary amide wax, followed by a desintegration step, resulting in discrete particles, which are then at least partially coated with the metal oxide nanoparticles. The desintegration can be performed by atomisation of the melt by a gas or a liquid medium or through a combination of cooling down the melt until it is solidified and grinding the solidified mixture into discrete particles. The first discrete particles of fatty primary monoamide wax at least partially coated with metal oxide nanoparticles are then combined with the second discrete particles of fatty bisamide wax in predetermined proportions.

In some implementations, the composite lubricant including first discrete particles of fatty primary monoamide wax at least partially coated with metal oxide nanoparticles combined with the second discrete particles of fatty bisamide wax improved the ejection behavior by reducing the ejection forces, improved the flow properties, and showed an adequate resistance to humidity, compared with traditional powder metallurgy lubricants.

In another embodiment, the particulate composite lubricant comprises a Montan acid ester wax and a fatty amide wax. The fatty amide wax comprises a fatty primary monoamide wax, a fatty secondary monoamide wax, a fatty bisamide wax, or mixtures thereof. The lubricant is stearate free.

In an embodiment, the composite lubricant comprises between about 0.5 wt % and about 90 wt % of Montan acid ester wax and between about 10 wt % and about 99.5 wt % of fatty amide wax. In an alternative embodiment, the composite lubricant comprises between about 5 wt % and about 75 wt % of Montan acid ester wax and, in still an alternative embodiment, it comprises between about 10 wt % and about 65 wt % of Montan acid ester wax. In an alternative embodiment, the composite lubricant comprises between about 25 wt % and about 95 wt % of fatty amide wax and, in still an alternative embodiment, it comprises between about 35 wt % and about 90 wt % of fatty amide wax.

In this specification, the term "Montan acid ester wax" is intended to mean the products obtained from esterification of montanic acids with long chain aliphatic alcohols or multifunctional alcohols (diols, triols, . . . ). Montanic acids are produced from hydrolysed/oxidized refined Montan wax. Montan wax is produced by solvent extraction of lignite or brown coal. The crude Montan wax which is a black-brown, hard, brittle product is further refined by removing resins and asphaltenes with various organic solvents, distillation and fractionation. The wax component of Montan is a mixture of long-chain (C24-C30) esters (62-68 wt %), long-chain acids (22-26 wt %), and long-chain alcohols, ketones, and hydrocarbons (7-15 wt %). In this specification, montanic acid ester waxes do not include products that are partly saponified with for instance calcium or sodium hydroxide producing metal soaps which could leave stains on compacted parts after delubrication and sintering.

In an embodiment, the montanic acid ester waxes have a drop point of 70° C. to 90° C., and, in an alternative embodiment, between 75° C. and 85° C., an acid value (mgKOH/g) in a range between 5 and 30, and, in an alternative embodiment, between 9 and 20, a saponification number (mg KOH/g) between 100 and 200, and, in an alternative embodiment, between 140 and 170, a viscosity at 100° C. between 20 and 150 mPa·s In an embodiment, the fatty amide wax comprises primary monoamide(s), secondary monoamide(s), and/or bisamide(s). The fatty amide wax can comprise mixtures thereof. In an embodiment, the fatty amide wax is selected from the group consisting of lauramide, palmitamide, stearamide, oleamide, arachidamide, behenamide, erucamide, stearyl stearamide, stearyl oleamide, stearyl erucamide, oleyl palmitamide, oleyl stearamide, erucyl stearamide, erucyl erucamide, ethylene bisstearamide, ethylene bisoleamide, hexamethylene bisstearamide, and mixtures thereof.

In an embodiment, the particulate composite lubricant can further contain additional discrete particles of an organic metal-free pulverulent lubricant such as and without being limitative fatty bisamide waxes, fatty monoamide waxes, glycerides, Montan acid ester waxes, paraffin wax, polyolefines, polyamides, polyesters, and mixtures thereof.

In an embodiment, the particulate composite lubricant comprises first discrete particles including the Montan acid ester wax. The first discrete particles can further include the fatty amide wax. For instance, they can include at least one of the fatty primary monoamide wax and the fatty bisamide wax. If the first discrete particles include the fatty primary monoamide wax, they can further comprise a coating of metal oxide nanoparticles. The particulate composite lubricant can further comprise second discrete particles of an organic metal-free pulverulent lubricant. For instance, the second discrete particles can include at least one of fatty primary monoamide wax and fatty bisamide wax. In an embodiment, if the first discrete particles comprise a combination of Montan acid ester wax and the fatty primary monoamide wax, the second discrete particles, if any, can comprise a fatty bisamide wax. In an alternative embodiment, if the first discrete particles comprise a combination of Montan acid ester wax and the fatty bisamide wax, the second discrete particles, if any, can comprise a fatty primary monoamide wax, which can be at least partially coated with metal oxide nanoparticles.

For instance and without being limitative, in an embodiment, the particulate composite lubricant comprises first discrete particles of erucamide/Montan acid ester wax, which can be at least partially covered with metal oxide nanoparticles, mixed with second discrete particles of EBS, which can also include Montan acid ester wax. In this embodiment, erucamide is the fatty amide wax of the particulate composite lubricant and the discrete particles of EBS, including or not Montan acid ester wax, act as the additional organic metal-free pulverulent lubricant. In another embodiment, the particulate composite lubricant comprises discrete particles of EBS/Montan acid ester wax. In this embodiment, EBS is the fatty amide wax of the particulate composite lubricant. The composite lubricant can include second discrete particles of erucamide, at least partially coated or uncoated with metal oxide nanoparticles, as an additional organic metal-free pulverulent lubricant. In still another embodiment, the first discrete particles can include the Montan acid ester wax and the second discrete particles can include either EBS or erucamide, at least partially coated or uncoated with metal oxide nanoparticles. In an alternative embodiment, the composite lubricant can include solely first discrete particles including a mixture of EBS/Montan acid ester wax or a mixture of erucamide/Montan acid ester wax, at least partially coated or uncoated with metal oxide nanoparticles. In this embodiment, the composite lubricant is free of discrete particles of an additional organic metal-free pulverulent lubricant.

In still another embodiment, the particulate composite lubricant is either composed of first discrete particles of Montan acid ester wax and second discrete particles of fatty primary monoamide wax, such as erucamide, at least partially coated or uncoated with metal oxide nanoparticles, or is obtained by melting and further cooling/grinding or by atomization of both fatty primary monoamide and Montan acid ester waxes.

For instance, the composite lubricant can include first discrete particles including a mixture of Montan acid ester and fatty primary monoamide waxes wherein the concentration of the Montan acid ester wax ranges between about 0.5 wt % and about 90 wt %, the remaining including the fatty primary monoamide wax and the optional metal oxide nanoparticle coating. The composite lubricant can further include second discrete particles of an additional organic metal-free pulverulent lubricant such as and without being limitative, a fatty bisamide wax.

In another implementation, the composite lubricant can include first discrete particles including a mixture of Montan acid ester and fatty bisamide waxes wherein the concentration of the Montan acid ester wax ranges between about 0.5 wt % and about 90 wt %, the remaining including the fatty bisamide wax. The composite lubricant can further include second discrete particles of an additional organic metal-free pulverulent lubricant such as and without being limitative, a fatty primary monoamide wax with an optional metal oxide nanoparticle coating.

In still another implementation, the composite lubricant can include first discrete particles including the Montan acid ester wax and second discrete particles including the fatty primary monoamide wax. The composite lubricant can further include third discrete particles of an additional organic metal-free pulverulent lubricant such as and without being limitative, a fatty bisamide wax. The concentration of the Montan acid ester wax ranges between about 0.5 wt % and about 90 wt %, the remaining including the fatty primary monoamide wax and the additional organic metal-free pulverulent lubricant, if any.

In a further implementation, the composite lubricant can include first discrete particles including the Montan acid ester and second discrete particles including the fatty bisamide wax. The composite lubricant can further include third discrete particles of an additional organic metal-free pulverulent lubricant such as and without being limitative, a fatty primary monoamide wax with an optional metal oxide nanoparticle coating. The concentration of the Montan acid ester wax ranges between about 0.5 wt % and about 90 wt %, the remaining including the fatty bisamide wax and the additional organic metal-free pulverulent lubricant, if any.

In an embodiment, the discrete particles of fatty acid amide wax/Montan acid ester wax have a diameter smaller than about 250 μm and having an average particle size larger than about 10 μm. In an embodiment, the discrete particles of fatty acid amide wax/Montan acid ester wax are characterized by an average particle size between about 15 μm and about 100 μm and, in another embodiment, between about 25 μm and about 75 μm. In an embodiment, they are characterized by a D99 between about 80 μm and about 220 μm, i.e. 99% of the particles are smaller than the D99, and, in another embodiment, between about 115 μm and about 180 μm.

The Montan acid ester and fatty amide waxes are micronized in spherical particles of different particle size distributions and the concentration of each one of the components can be varied in the powder mix to optimise the behaviour of the composite lubricant.

In an embodiment, the Montan acid ester and fatty amide waxes are added to the metal powder as discrete particles of Montan acid ester wax and discrete particles of fatty amide wax. Depending on the nature of the fatty amide wax(es), the discrete particles of fatty amide wax(es) can be at least partially coated with metal oxide nanoparticles in a manner such that the metal oxide nanoparticles adhere to the outer surface of the fatty amide wax particles. For instance and without being limitative, if the fatty amid wax includes erucamide, the discrete particles can include an at least partial coating of metal oxide nanoparticles.

In another embodiment, to manufacture the particulate composite lubricant, the lubricant particles can be prepared by melting together the Montan acid ester and fatty amide waxes, followed by a desintegration step, resulting in discrete particles containing a mixture of Montan acid ester and fatty amide waxes, which can be at least partially coated with metal oxide nanoparticles. The desintegration can be performed by atomisation of the melt by a gas or a liquid medium or through a combination of cooling down the melt until it is solidified and grinding the solidified mixture into discrete particles.

The Montan acid ester and fatty amide waxes are added, as a composite lubricant, to metal powder to obtain a metallurgical powder composition. As mentioned above, they can be added as distinct and discrete particles or as particles including both the Montan acid ester and fatty amide waxes. The metal powder can be a metal powder mix including several types of metal powder mixed together or include only one type of metal powder.

The above-described particulate composite lubricant can be mixed with a metal-based powder, such as and without being limitative, an iron-based powder to obtain a powder metallurgical composition. In an embodiment, the lubricant can be added in a concentration ranging between about 0.1 wt % and about 5 wt % of the powder metallurgical composition. In an embodiment, the concentration is less than about 2 wt % and, in another embodiment, between about 0.2 wt % and about 1 wt % of the powder metallurgical composition. The metal powder can be a metal powder mix including several types of metal powder mixed together or including only one type of metal powder. The metal powders can be iron-based metal powders suitable, for instance for medium range density parts (for instance, between 6.8 and 7.4 grams per cubic centimeter ($g/cm^3$)). The metallurgical powder composition including the metal powder and the composite lubricant is used to manufacture compacted parts through powder metallurgy. The composite lubricant is typically added to the powder mix at the very end of the manufacturing process. The powder metallurgical composition can further include binders, processing aides, hard phases, machinability enhancing agents, and the like.

It will be appreciated that the methods described herein may be performed in the described order, or in any other suitable order.

It has been found that, in some implementations, the addition of Montan acid ester wax to the fatty amide wax improves the flowability and the apparent density of the powder metallurgical compositions containing same.

Example A

A first embodiment of the particulate composite lubricant will be described. The composite lubricant comprises a mixture of discrete particles of fatty monoamide wax partially coated with fumed silica nanoparticles and discrete particles of fatty bisamide wax. More particularly, it includes a mixture of erucamide, as fatty monoamide wax, and ethylene bisstearamide as fatty bisamide wax. In the composite lubricant, the concentration of fatty monoamide wax varies between about 10 wt % to about 60 wt %. In this example, substantially spherical-shaped erucamide particles were used produced by a melting, spray micronizing process and at least partially coated with 0.5 wt % fumed silica nanoparticles (FIG. 1) to protect erucamide from the ambient humidity. The fumed silica coated particles were characterized with an average particle size of about 63 μm and all particles had a diameter smaller than about 250 μm.

In this example, all powder mixes were prepared using ATOMET 1001HP, a water-atomised steel powder, manufactured by Rio Tinto Metal Powders. Each was admixed with 1.8 wt % copper, 0.7 wt % natural graphite, and 0.7 wt % of a lubricant. The particulate composite lubricant tested in this example (Mix ID-1) included 40 wt % of erucamide particles coated with fumed silica nanoparticles and 60 wt % of Acrawax® C particles, as fatty bisamide wax.

Two iron-based powder mixes were used as benchmarks. A first one of the iron-based powder mixes contained Kenolube™ P11 (Mix ID-2) and a second one of the iron-based powder mixes contained atomized Acrawax® C (Mix ID-3). Kenolube™ P11 and Acrawax® C are commercially-available and well-known lubricants which are widely used in the PM industry. Acrawax® C is an amide wax and, more particularly, a N,N'-ethylene bisstearamide having a mean particle size of about 5-7 μm and Kenolube™ P11 is a composition of 22.5 wt % zinc stearate and 77.5 wt % of an amide wax. Table 1, below, describes the iron-based powder mixes that were evaluated for their compaction and ejection performance.

TABLE 1

Powder mixes used to determine the compaction and ejection behaviour of three lubricants.

| Mix ID | Base Powder | Copper | Graphite | Lubricant |
|---|---|---|---|---|
| 1 | AT-1001HP | 1.8 wt % | 0.7 wt % | 0.7 wt % [0.28 wt % Coated Erucamide + 0.42 wt % Acrawax ® C] |
| 2 | | | | Kenolube ™ P11 0.7 wt % |
| 3 | | | | Acrawax ® C 0.7 wt % |

The apparent density and flow rate were measured using a Hall flow meter apparatus, according to MPIF Standard 4 and 3, respectively (MPIF, Standard Test Methods for Metal Powders and Powder Metallurgy Products—2012 Edition, Princeton, N.J. (USA): Metal Powder Industries Federation; 2012, 150p.). The compaction and ejection behaviour were evaluated at the National Research Council Canada (Boucherville, Canada) on a 150 ton mechanical press. The press is equipped with strain gauges which can record the pressure applied on the top and bottom punch throughout the entire compaction and ejection process. 12.7 mm height rings of 25.4 mm across with a core pin diameter of 14.2 mm were compacted at 5 parts per minute on a tungsten carbide die. The parts had an M/Q ratio of 4.54, while a standard TRS bar made according to MPIF standard 60 has an M/Q ratio of about 1.4. In order to obtain complete compressibility curves, parts were pressed at four compaction pressures of 485, 620, 715 and 825 MPa.

Results, shown in Table 2, below, and in FIGS. 3 to 6 showed similar compressibility for the Mix ID-1 than Acrawax® C (Mix ID-3) and Kenolube™ P11 (Mix ID-2). Ejection performances for Mix ID-1 were similar to Kenolube™ P11 (Mix ID-2), but significantly better than Acrawax® C (Mix ID-3).

TABLE 2

Results for the powder mixes detailed in Table 1.

| Mix ID | Compaction Pressure (tsi) | Green Density (g/cc) | Stripping Pressure (tsi) | Sliding Pressure (tsi) | Out of Die Sliding Pressure (tsi) |
|---|---|---|---|---|---|
| 1 | 35.5 | 6.96 | 0.90 | 0.82 | 0.75 |
| | 45.4 | 7.12 | 1.00 | 0.91 | 0.80 |
| | 51.7 | 7.18 | 0.98 | 0.87 | 0.76 |
| | 59.4 | 7.22 | 0.93 | 0.80 | 0.67 |
| 2 | 35.7 | 7.00 | 0.88 | 0.78 | 0.68 |
| | 44.5 | 7.14 | 0.96 | 0.86 | 0.75 |
| | 52.3 | 7.22 | 0.91 | 0.81 | 0.69 |
| | 59.3 | 7.25 | 0.89 | 0.78 | 0.66 |
| 3 | 35.8 | 6.97 | 0.96 | 0.87 | 0.76 |
| | 45.6 | 7.15 | 1.17 | 1.07 | 0.94 |
| | 53.0 | 7.19 | 1.19 | 1.09 | 0.97 |
| | 59.5 | 7.23 | 1.20 | 1.09 | 0.94 |

Example B

In this example, the resistance of two iron-based powder mixes to warm and humid environments was measured according to a procedure established in Thomas et al. (2009) (Thomas, Y.; St-Laurent, S.; Pelletier, S.; Gélinas, C. In *Effect of Atmospheric Humidity and Temperature on the Flowability of Lubricated Powder Metallurgy Mixes*, Advances in Powder Metallurgy & Particulate Materials, Las Vegas, Jun. 28-Jul. 1, 2009; MPIF, Princeton, N.J., USA.). Samples based on an AT-1001HP base powder and containing 0.6 wt % of natural graphite, 0.3 wt % MnS and 0.8 wt % of lubricant were prepared. The mixes are described in Table 3, below.

TABLE 3

Description of the powder mixes used to evaluate the resistance to humidity.

| Mix ID | Base Powder | Graphite | MnS | Lubricant |
|---|---|---|---|---|
| 4 | AT-1001HP | 0.6 wt % F25 | 0.3 wt % Arcmetal | 0.8 wt % [0.32 wt % Coated Erucamide + 0.48 wt % Acrawax ® C] |
| 5 | | | | Kenolube ™ 0.8 wt % |
| 6 | | | | 0.8 wt % [0.32 wt % non-coated Erucamide + 0.48 wt % Acrawax ® C] + fumed silica added to the metal powder mix |

Highly hygroscopic lubricants would not flow after the conditioning period whereas non-hygroscopic lubricants are expected to maintain their flow behaviour. To perform this test, samples of 1 kilogram (kg) of the iron-based powder mixes were placed in a Blue M climate-controlled chamber which is equipped with a small V-type blender. Each powder blend was placed in the blender which was left open for an approximate period of one hour. This time span is necessary for the powder mixes to reach equilibrium with its surrounding environment. For this test, the chamber was set at a temperature of 60° C. and 60% RH. After this period, the blender was closed and the powder mixes blended for 30 minutes, after which a sample was collected. After the sampling was completed, the blender was turned on for a period of 24 hours. Once this period was over, another sample was taken. The flow rate and apparent density were measured on the first sample (taken out after 30 minutes of blending time). The last sample was also measured after a 24 h rest period.

Figure 7:
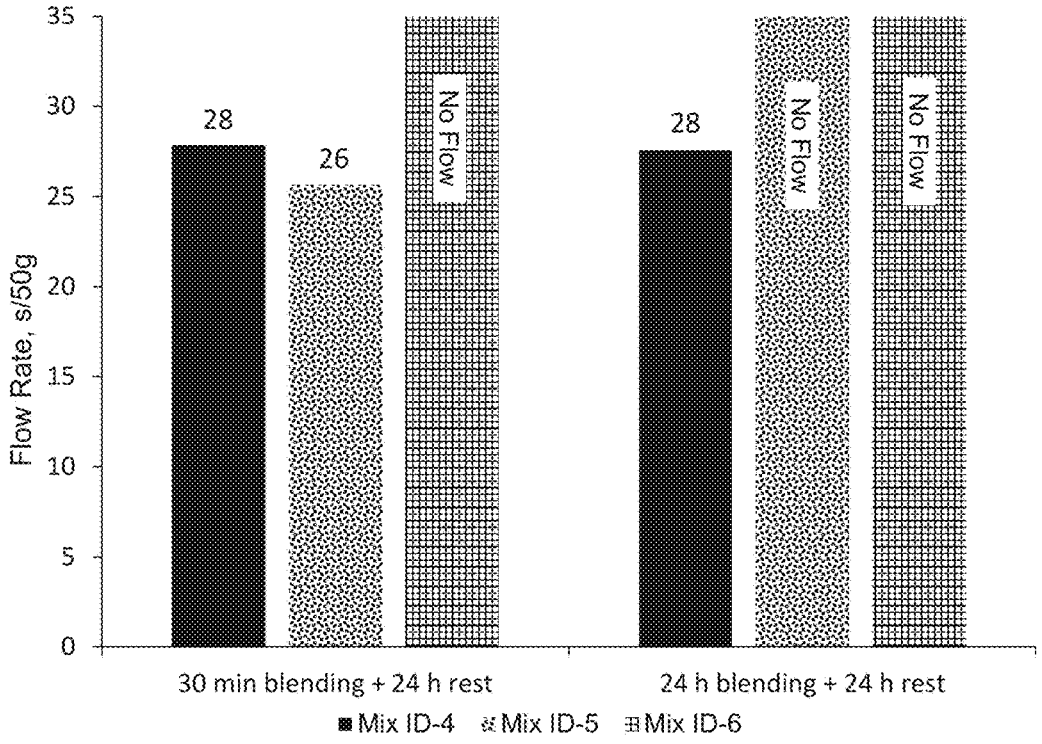
FIG. 7 is a graph showing the Hall flow rate for 30 minutes and 24 hours of blending followed by 24 hours of rest for two lubricants of example B.
Figure 8:
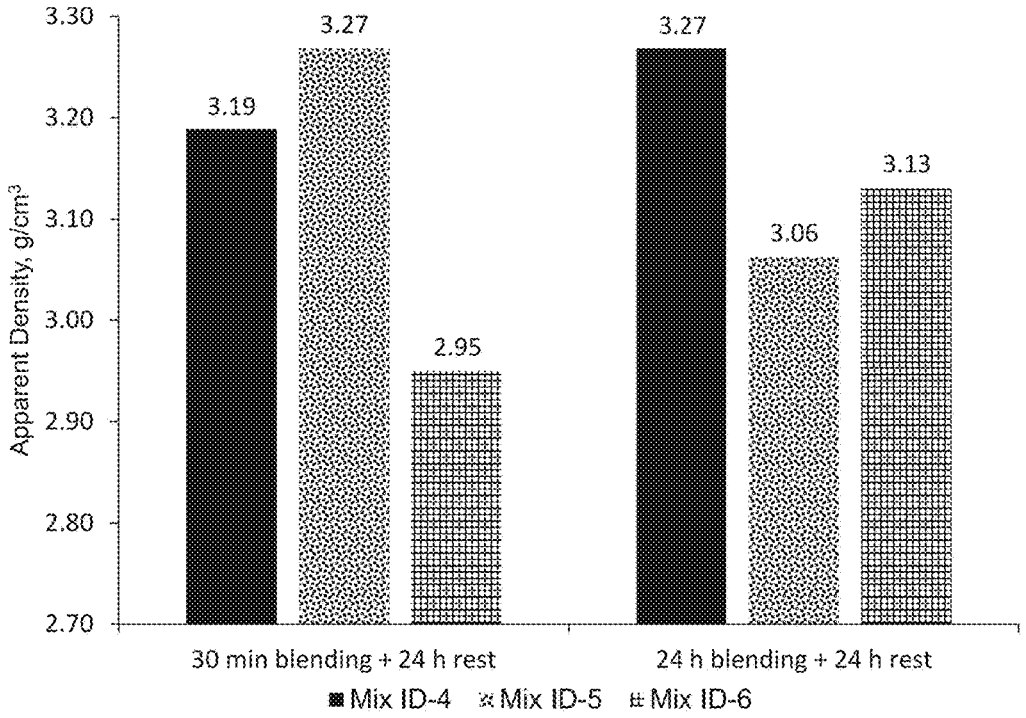
FIG. 8 is a graph showing the Hall apparent density for 30 minutes and 24 hours of blending followed by 24 hours of rest for the two lubricants of example B.
Figure 9:
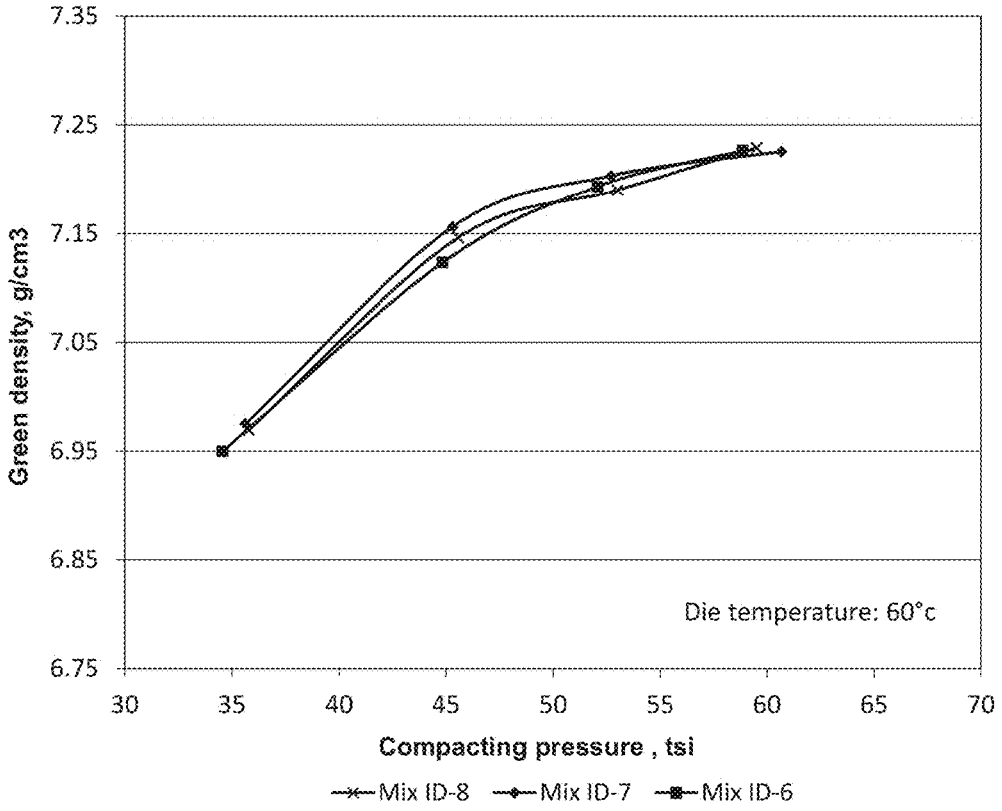
FIG. 9 is a graph showing the green density as a function of the compacting pressure for three lubricants of example C.
Figure 10:
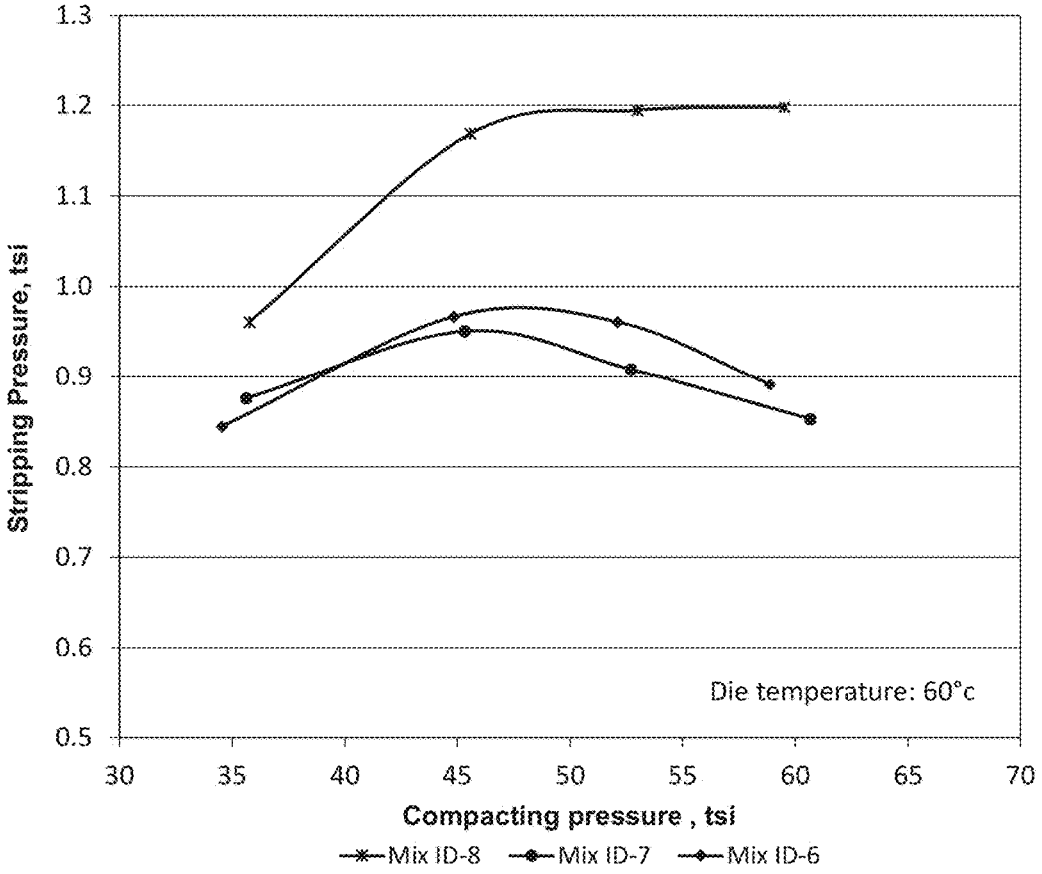
FIG. 10 is a graph showing the stripping pressure as a function of the compacting pressure for the three lubricants of example C.
Figure 11:
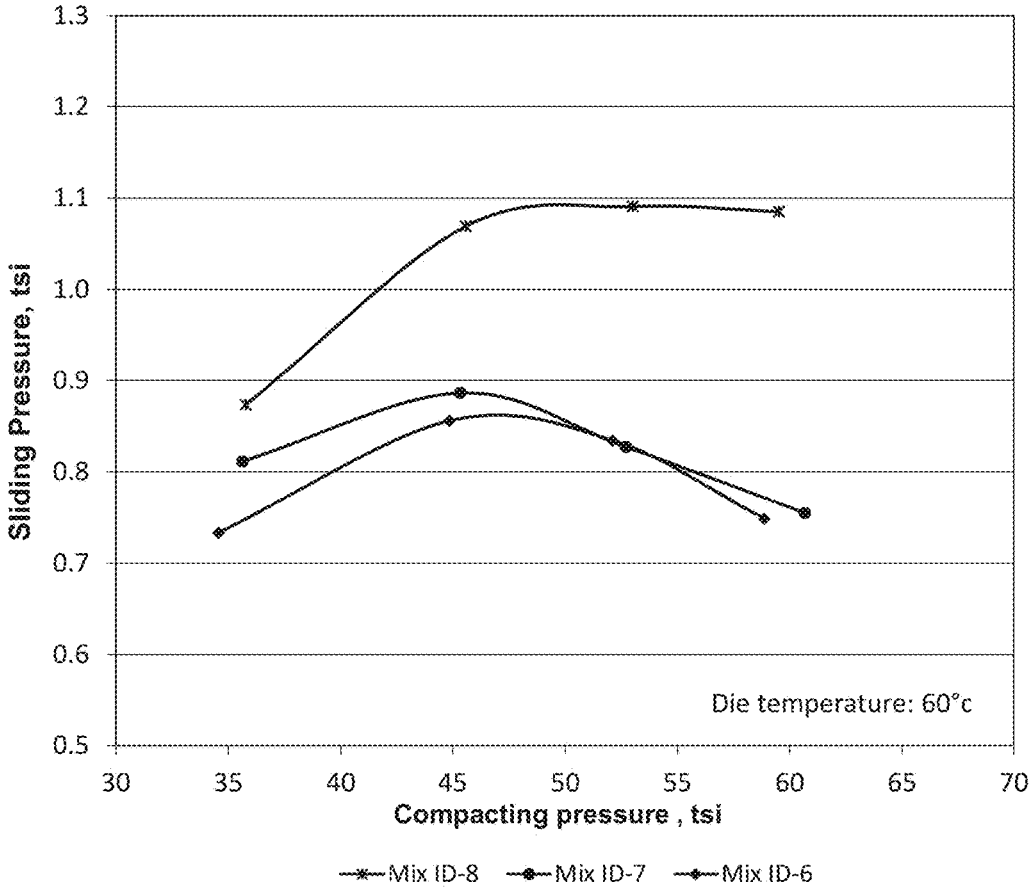
FIG. 11 is a graph showing the sliding pressure as a function of the compacting pressure for the three lubricants of example C.
Figure 12:
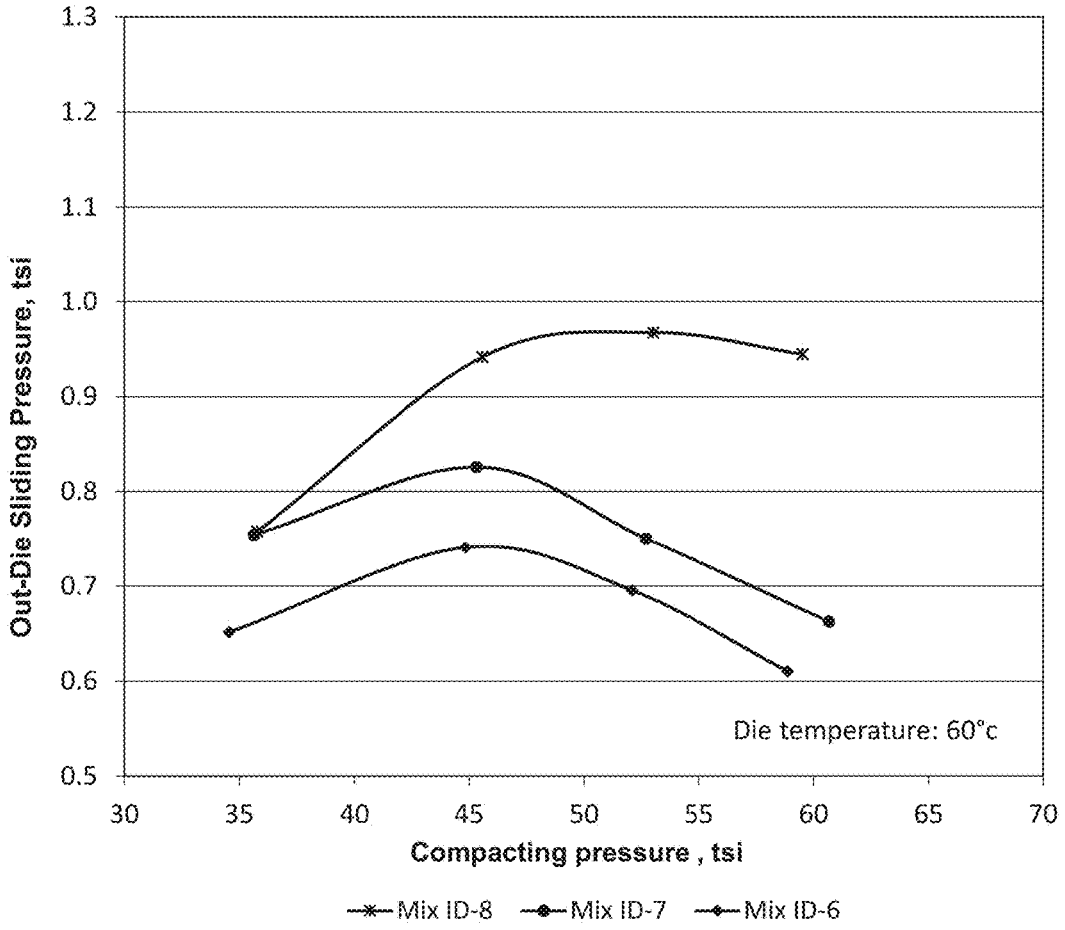
FIG. 12 is a graph showing the out of die sliding pressure as a function of the compacting pressure for the three lubricants of example C.

Results are shown in FIGS. 7 and 8. Both lubricants in Mixes ID-4 and ID-5 had a good Hall flow rate following a short exposure to a warm and humid atmosphere. This was not the case for Mix ID-6 which already showed no measurable flow. This indicates that the admixing of fumed silica to the powder mix cannot protect it against the exposure to humid environments. On the other hand, after a longer exposure to humidity, Mix ID-4 is the only mix that flows indicating the benefits of using the erucamide particles coated with the fumed silica. Regarding apparent density, slightly higher values were obtained for Mix ID-4 while a significant reduction of apparent density was observed for Mix ID-5 after a long exposure to a humid atmosphere. The coated erucamide consequently offers a good protection against humidity exposure.

Example C

In this example, another embodiment of the particulate composite lubricant will be described in which the composite lubricant comprises a mixture of two components. More particularly, it includes a mixture of erucamide, as fatty amide wax, and Montan acid ester wax, a non-polar wax, to reduce the tendency of erucamide to combine with water. In the composite lubricant, the concentration of Montan acid ester wax varies between about 0.5 wt % to about 90 wt %. The mixture is heated, melted and blended in such a way that the two waxes are substantially evenly mixed and, then, spray micronized into substantially spherical-shaped particles. During the spray micronization step, a coating of fumed silica nanoparticles, or other suitable oxide, can be adhered onto the particles. For instance and without being limitative, the amount of fumed silica added as a coating to the spray micronized particles can vary between about 0% (when the particles are non-coated) to about 2 wt %.

In this example, all powder mixes were prepared using ATOMET 1001HP, a water-atomised steel powder, manufactured by Rio Tinto Metal Powders. Each one of the powder mixes was admixed with 1.8 wt % copper, 0.7 wt % natural graphite and 0.7 wt % of lubricant.

Table 4 describes the powder mixes that were evaluated for their compaction and ejection performance. Mix ID-7 included 40 wt % of erucamide discrete particles coated with fumed silica nanoparticles and 60 wt % of Acrawax® C discrete particles, as bisamide wax. The erucamide particles were atomized and coated with 0.5 wt % fumed silica nanoparticles. The silica fumed coated particles were characterized with an average particle size of about 63 μm and all particles had a diameter smaller than about 250 μm. Mix ID-8 included 50 wt % of discrete particles of a melted and further spray micronized mixture of erucamide and Montan acid ester wax in a weight ratio of 40% erucamide and 60% Montan acid ester wax. The particles of erucamide/Montan acid ester wax were characterized by an average particle size of about 56 μm and 99% of the particles being smaller than about 160 μm. The remaining 50 wt % is composed of discrete atomized EBS particles with a diameter smaller than about 35 μm. A powder mix was used as benchmark and contained Acrawax® C atomized (Mix ID-9).

TABLE 4

Powder mixes used to determine the compaction and ejection behaviour of the lubricants.

| Mix ID | Base Powder | Copper | Graphite | Lubricant |
|---|---|---|---|---|
| 7 | AT-1001HP | 1.8 wt % | 0.7 wt % | 0.7 wt % [0.28 wt % Coated Erucamide + 0.42 wt % Acrawax ® C] |
| 8 | | | | 0.7 wt % [0.35 wt % Erucamide/Montan acid ester wax + 0.35 wt % atomized EBS < 35 μm] |
| 9 | | | | Acrawax ® C atomized 0.7 wt % |

The apparent density, the flow rate, and the compaction and ejection behaviour were measured and evaluated as described above for Example A.

The metallurgical powder composition including an iron-based powder admixed with this Montan acid ester wax containing particulate composite lubricant showed good compaction and ejection performance and flowability, as shown in Table 5 and FIGS. 9 to 13, which will be described in more details below.

Both Mix ID-7 and Mix ID-8 have similar compressibility as well as similar compressibility to Mix ID-9 containing Acrawax® C. However, both Mixes ID-7 and ID-8 containing both the lubricants of the invention have significantly better performance than Acrawax® C with significantly lower ejection pressures.

Figure 13:
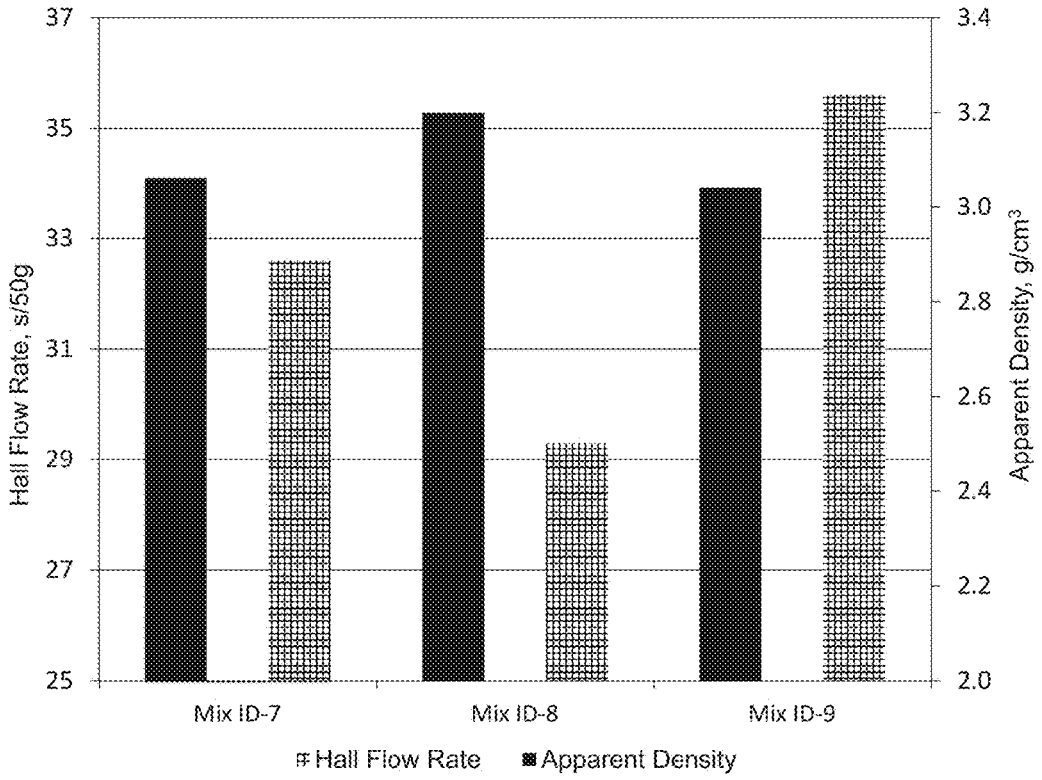
FIG. 13 is a graph showing the Hall flow rate and apparent density for the three lubricants of example C.

Results for the flow rate and apparent density are described in the FIG. 13. The composite lubricant containing the melted and further spray micronized particles of a mixture of Montan acid ester wax and erucamide and particles of atomized EBS<35 μm lead to the mix having the best flowability. Mix ID-8 has indeed better flow than Mix ID-7 containing coated erucamide particles and Acrawax® C, and significantly better flow behavior than Mix ID-9 containing only Acrawax® C. On the other hand, the apparent density of Mix ID-8 containing the Montan acid ester/erucamide composite lubricant is the highest, slightly higher than the two other iron powder Mixes ID-7 and ID-9.

TABLE 5

Results for the powder mixes detailed in Table 4.

| Mix ID | Lubricant | Compaction Pressure (tsi) | Green Density (g/cm$^3$) | Stripping Pressure (tsi) | Sliding Pressure (tsi) | Out of Die Sliding Pressure (tsi) |
|---|---|---|---|---|---|---|
| 7 | 0.7 wt % | 34.5 | 6.95 | 0.84 | 0.73 | 0.65 |
| | [0.28 wt % Coated | 44.8 | 7.12 | 0.97 | 0.86 | 0.74 |
| | Erucamide* + 0.42 wt | 52.1 | 7.19 | 0.96 | 0.83 | 0.70 |
| | % Acrawax ® C] | 58.9 | 7.23 | 0.89 | 0.75 | 0.61 |
| 8 | 0.7 wt % | 35.6 | 6.975 | 0.88 | 0.81 | 0.754 |
| | [0.35 wt % | 45.3 | 7.156 | 0.95 | 0.89 | 0.826 |
| | Erucamide/Montanic | 52.7 | 7.203 | 0.91 | 0.83 | 0.750 |
| | Ester** + 0.35 wt | 60.7 | 7.226 | 0.85 | 0.76 | 0.663 |
| | % atomized EBS | | | | | |
| | < 35 μm] | | | | | |
| 9 | 0.7 wt % | 35.8 | 6.97 | 0.96 | 0.87 | 0.76 |
| | Acrawax ® C | 45.6 | 7.15 | 1.17 | 1.07 | 0.94 |
| | atomized | 53.0 | 7.19 | 1.19 | 1.09 | 0.97 |
| | | 59.5 | 7.23 | 1.20 | 1.09 | 0.94 |

*Atomized erucamide coated with 0.5 wt % fumed silica having an average particle size of about 63 μm and all particles smaller than about 250 μm.
**Atomized erucamide/Montan acid ester wax having an average particle size of 56 μm and 99% of the particles smaller than about 160 μm

Example D

In this fourth example, another embodiment of the composite lubricant will be described. The composite lubricant comprises a mixture of two components and, more particularly, a mixture of ethylene bisstearamide (EBS), as fatty amide wax, and Montan acid ester wax. In this example, the concentration of Montan acid ester wax is either 50 wt % or 10 wt %. As described for example C, the mixture of both components is heated and melted, blended in such a way that the two waxes are substantially evenly mixed and spray micronized into substantially spherical-shaped particles. To be able to compare adequately the lubricant performances, spherical-shaped particles were also produced from pure EBS and pure Montan acid ester wax with similar particles sizes (average particle size of about 40 μm to 50 μm and all particles with a diameter smaller than about 250 μm).

In this example, all powder mixes were prepared using ATOMET HP, a water-atomised steel powder, manufactured by Rio Tinto Metal Powders. Each was admixed with 1.8 wt % copper, 0.7 wt % natural graphite, and 0.7 wt % of a lubricant in a V-blender at a temperature of 40° C. to 50° C. to simulate industrial mixing conditions. Table 6, below, describes the iron-based powder mixes that were evaluated for their compaction and ejection performance. The first iron powder mix (Mix ID-10) contained the particulate composite lubricant where a mixture of 50% EBS and 50% Montan acid ester waxes was first melted and further spray micronized. The second powder mix contained a mixture of 50% of EBS spherical particles and 50% of Montan acid ester wax spherical particles (Mix ID-11). Two other powder mixes (Mix ID-12 and Mix ID-13) contained either pure Montan acid ester wax or EBS lubricant described previously in this example. Another mix (Mix ID-16) contained the particulate composite lubricant where a mixture of 90% EBS and 10% Montan acid ester waxes was first melted and further spray micronized.

Two iron-based powder mixes were also used as benchmarks. The first one (Mix ID-14) contained Kenolube™ P11 and the second (Mix ID-15) contained atomized Acrawax® C. Both Kenolube™ P11 and Acrawax® C are commercially-available and well-known lubricants which are widely used in the PM industry. Acrawax® C is an amide wax and, more particularly, a N,N'-ethylene bisstearamide and Kenolube™ P11 is a composition of 22.5 wt % zinc stearate and 77.5 wt % of an amide wax.

TABLE 6

Powder mixes used to determine the lubricants performances.

| Mix ID | Base Powder | Copper | Graphite | Lubricant |
|---|---|---|---|---|
| 10 | AT-1001HP | 1.8 wt % | 0.7 wt % | 0.7 wt % [50/50 EBS/Montan acid ester] |
| 11 | | | | 0.7 wt % [0.35 wt % Montan acid ester + 0.35 wt % EBS] |

TABLE 6-continued

Powder mixes used to determine the lubricants performances.

| Mix ID | Base Powder | Copper | Graphite | Lubricant |
|---|---|---|---|---|
| 12 | | | | Montan acid ester wax 0.7 wt % |
| 13 | | | | EBS 0.7 wt % |
| 14 | | | | Kenolube ™ P11 0.7 wt % |
| 15 | | | | Acrawax ® C 0.7 wt % |
| 16 | | | | 0.7 wt % [90/10 EBS/Montan acid ester] |

The apparent density, the flow rate, and the compaction and ejection behaviour were measured and evaluated as described above for Example A.

Results are shown in FIGS. 14 to 18. The composite lubricant of the invention, both as discrete particles or melted and further spray micronized particles have excellent compaction and ejection performances. The presence of Montan acid ester wax (Mix ID-10 and Mix ID-11) enabled an increase in compressibility compared to the use of an EBS wax with similar particle size distribution (Mix ID-13).

Figure 14:
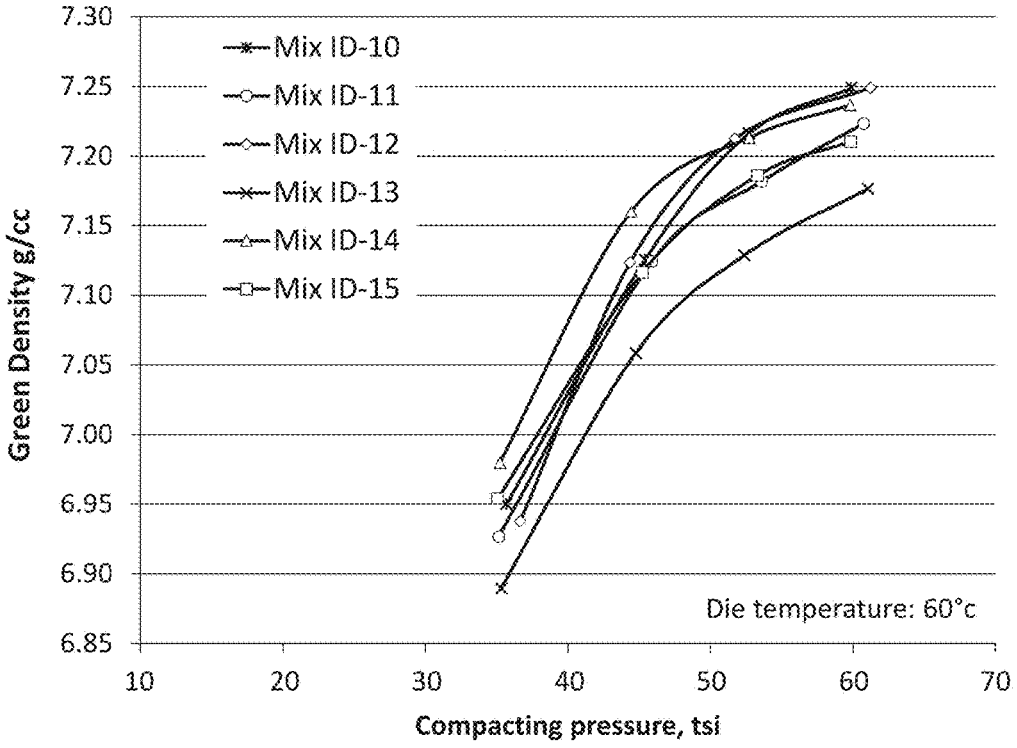
FIG. 14 is a graph showing the green density as a function of the compacting pressure for six lubricants of example D.
Figure 15:
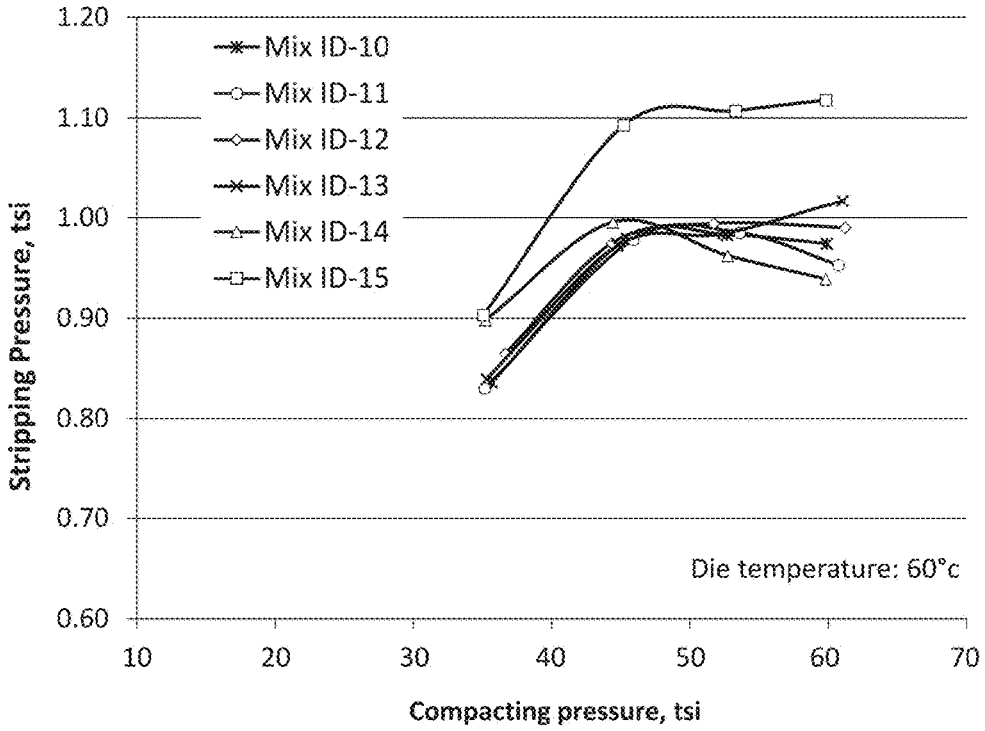
FIG. 15 is a graph showing the stripping pressure as a function of the compacting pressure for the six lubricants of example D.
Figure 16:
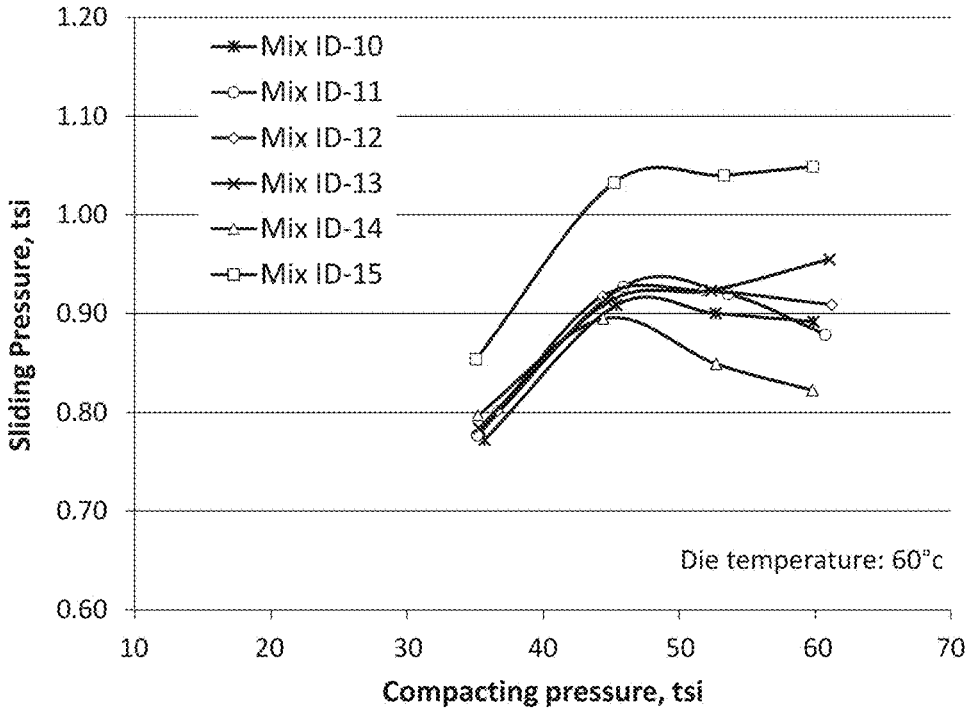
FIG. 16 is a graph showing the sliding pressure as a function of the compacting pressure for the six lubricants of example D.
Figure 17:
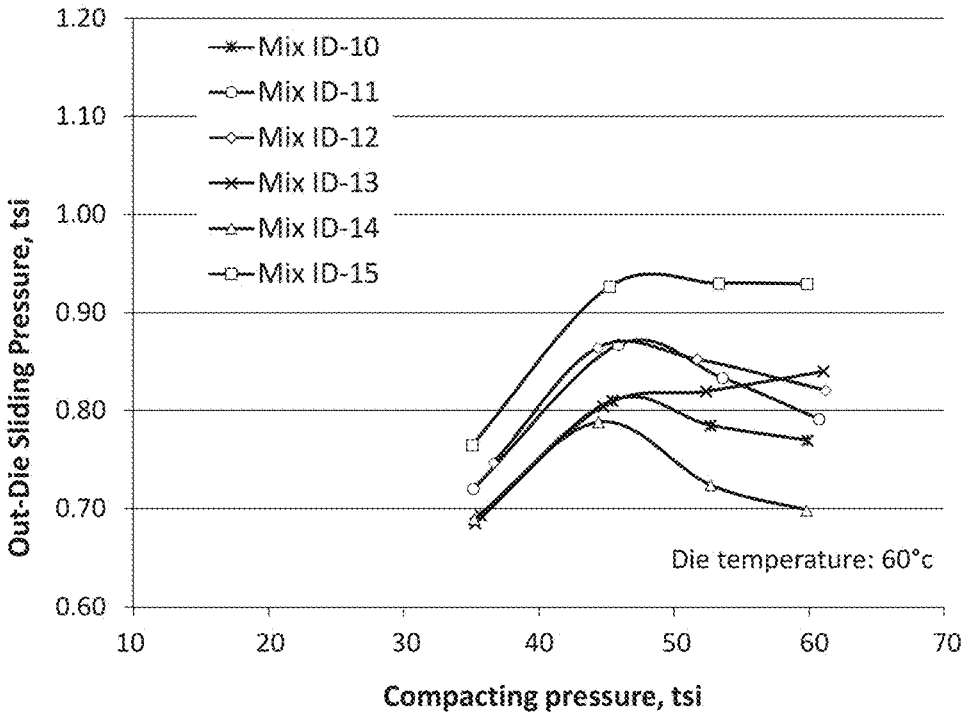
FIG. 17 is a graph showing the out of die sliding pressure as a function of the compacting pressure for the six lubricants of example D.

When a combination of discrete particles of Montan acid ester wax and EBS wax is used (Mix ID-11), the composite lubricant has similar compressibility to Acrawax® C (Mix ID-15) (FIG. 14). However, the ejection performance is significantly improved (FIGS. 15 to 17). The melted and further spray micronized particles (Mix ID-10) have a similar ejection performance to the discrete particles (Mix ID-11) but higher compressibility, similar to Kenolube™ (Mix ID-14) and pure Montan acid ester wax (Mix ID-12) was obtained.

Figure 18:
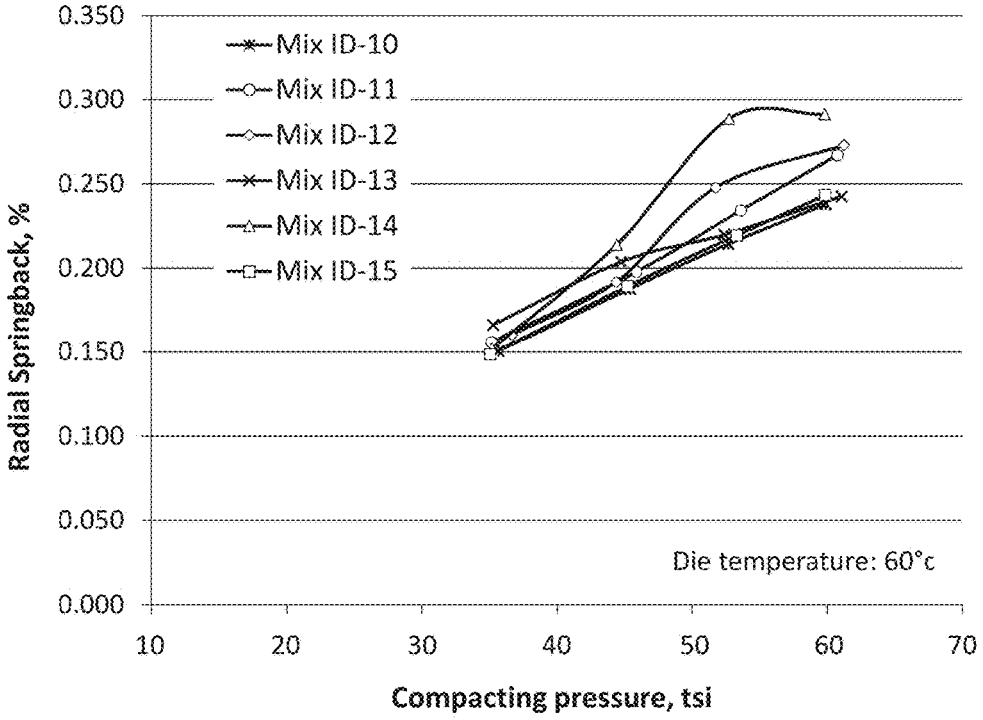
FIG. 18 is a graph showing the radial springback as a function of the compacting pressure for the six lubricants of example D.

FIG. 18 shows the springback of the parts following their ejection from the compaction die. Kenolube™ (Mix ID-14) had the highest springback and pure Montan acid ester wax (Mix ID-12) the second highest. The use of a combination of discrete particles of Montan acid ester wax and EBS wax (Mix ID-11) can slightly reduce the springback but the melted and further spray micronized particles (Mix ID-10) allows the springback to be reduced to levels comparable to EBS wax (Mix ID-13) and Acrawax® C (Mix ID-15) at high compaction pressures.

Figure 19:
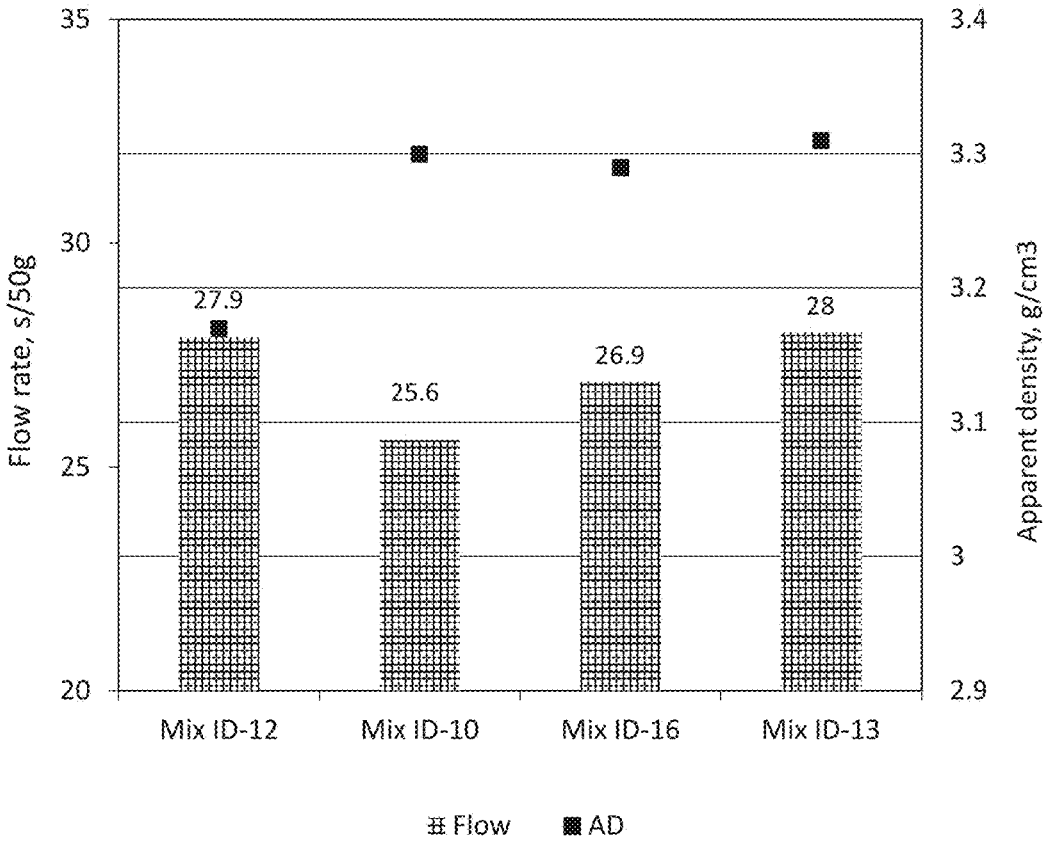
FIG. 19 is a graph showing the Hall flow rate and apparent density for four of the six lubricants of example D.

Results for the flow rate and apparent density are described in the FIG. 19. The composite lubricants containing either 10 wt % or 50 wt % Montan wax allows the iron powder Mixes ID-10 and ID-16 to have a better flow behavior than pure Montan wax (Mix ID-12) or pure EBS (Mix ID-13). The apparent density of the powder mixes containing the composite lubricants is similar to the mix containing pure EBS (Mix ID-13).

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A particulate composite lubricant for powder metallurgy comprising: first discrete particles comprising at least about 90 wt % of a fatty primary monoamide wax, being substantially free of fatty bisamide wax, and being at least partially coated with metal oxide nanoparticles and second metal-stearate free discrete particles comprising a fatty bisamide wax.

2. The particulate composite lubricant as claimed in claim 1, wherein the particulate composite lubricant comprises between about 10 wt % and about 60 wt % of the first discrete particles and between about 40 wt % and about 90 wt % of the second discrete particles.

3. The particulate composite lubricant as claimed in claim 1, wherein the first discrete particles consist essentially of the fatty primary monoamide wax at least partially coated with the metal oxide nanoparticles.

4. The particulate composite lubricant as claimed in claim 1, wherein the second discrete particles further comprise at least about 50 wt % of the fatty bisamide wax and less than about 10 wt % of a fatty primary monoamide wax.

5. The particulate composite lubricant as claimed in claim 1, wherein the second discrete particles further comprise at least about 90 wt % of the fatty bisamide wax.

6. The particulate composite lubricant as claimed in claim 1, wherein the metal oxide nanoparticles comprise at least one of iron oxides, fumed silica, $TiO_2$, $Al_2O_3$, $SnO_2$, $SiO_2$, $CeO_2$, and indium titanium oxide nanoparticles, and combinations thereof.

7. The particulate composite lubricant as claimed in claim 1, wherein the first discrete particles comprises less than about 5 wt % of metal oxide nanoparticles.

8. The particulate composite lubricant as claimed in claim 1, wherein the first discrete particles are smaller than about 250 μm and the second discrete particles have an average particle size smaller than about 50 μm.

9. The particulate composite lubricant as claimed in claim 1, wherein the at least partially coated first discrete particles have an average particle size between about 15 μm and about 100 μm.

10. The particulate composite lubricant as claimed in claim 1, wherein the second discrete particles are substantially metal free.

11. A metallurgical powder composition, comprising a metal-based powder admixed with the particulate composite lubricant as claimed in claim 1 in a concentration ranging between about 0.1 wt % and about 5 wt %.

12. A process for producing a powder composition for powder metallurgy, comprising:

adding the particulate composite lubricant as claimed in claim 1 in a concentration ranging between about 0.1 wt % and about 5 wt %, based on a total weight of the powder composition, to a metal-based powder.

13. A particulate composite lubricant for powder metallurgy comprising: first discrete particles comprising a fatty primary monoamide wax, being substantially free of fatty bisamide wax, and being at least partially coated with metal oxide nanoparticles, the at least partially coated first discrete particles having average particle size between about 15 μm and about 100 μm, and second metal-stearate free discrete particles comprising a fatty bisamide wax and having average particle size smaller than about 50 μm.

14. The particulate composite lubricant as claimed in claim 13, wherein the particulate composite lubricant comprises between about 10 wt % and about 60 wt % of the first discrete particles and the first discrete particles comprise at least about 90 wt % of the fatty primary monoamide wax.

15. The particulate composite lubricant as claimed in claim 13, wherein the particulate composite lubricant comprises between about 40 wt % and about 90 wt % of the second discrete particles.

16. The particulate composite lubricant as claimed in claim 13, wherein the first discrete particles consist essentially of the fatty primary monoamide wax at least partially coated with the metal oxide nanoparticles.

17. The particulate composite lubricant as claimed in claim 13, wherein the second discrete particles further comprise at least about 50 wt % of the fatty bisamide wax and less than about 10 wt % of a fatty primary monoamide wax.

18. The particulate composite lubricant as claimed in claim 13, wherein the second discrete particles further comprise at least about 90 wt % of the fatty bisamide wax.

19. The particulate composite lubricant as claimed in claim 13, wherein the second discrete particles are substantially metal free.

20. A metallurgical powder composition, comprising a metal-based powder admixed with the particulate composite lubricant as claimed in claim 13 in a concentration ranging between about 0.1 wt % and about 5 wt %.

* * * * *